US010862187B2

(12) United States Patent
Yasin et al.

(10) Patent No.: US 10,862,187 B2
(45) Date of Patent: Dec. 8, 2020

(54) VEHICULAR ANTENNA ASSEMBLIES

(71) Applicant: Laird Technologies, Inc., Earth City, MO (US)

(72) Inventors: Hasan Yasin, Grand Blanc, MI (US); Wassim Borchani, Grand Blanc, MI (US); Ayman Duzdar, Holly, MI (US); Joseph M. Combi, Grand Blanc, MI (US); Gary Keith Reed, Grand Blanc, MI (US)

( * ) Notice: Subject to any disclaimer, the term of this patent is extended or adjusted under 35 U.S.C. 154(b) by 515 days.

(21) Appl. No.: 15/656,792

(22) Filed: Jul. 21, 2017

(65) Prior Publication Data

US 2019/0006733 A1 Jan. 3, 2019

Related U.S. Application Data

(60) Provisional application No. 62/526,900, filed on Jun. 29, 2017, provisional application No. 62/532,751, filed on Jul. 14, 2017.

(51) Int. Cl.

| | |
|---|---|
| ***H01Q 1/12*** | (2006.01) |
| ***H01Q 1/38*** | (2006.01) |
| ***H01Q 1/32*** | (2006.01) |
| ***H01Q 1/36*** | (2006.01) |
| ***H01Q 9/42*** | (2006.01) |

(Continued)

(52) U.S. Cl.

CPC ..... *H01Q 1/1214* (2013.01); *H01Q 1/1207* (2013.01); *H01Q 1/3275* (2013.01);

(Continued)

(58) Field of Classification Search

CPC ..... H01Q 1/1207; H01Q 5/40; H01Q 9/36; H01Q 11/08; H01Q 1/38; H01Q 1/1214;

(Continued)

(56) References Cited

U.S. PATENT DOCUMENTS 4,362,353 A * 12/1982 Cobaugh ..... H05K 7/10 29/882

7,581,965 B1 9/2009 Upasani et al.

(Continued)

FOREIGN PATENT DOCUMENTS

| | | |
|---|---|---|
| DE | 102016123369 A1 | 6/2017 |
| EP | 3171454 A1 | 5/2017 |
| WO | WO2017/031272 A1 | 2/2017 |

OTHER PUBLICATIONS

European Extended Search Report and Opinion (11 pages) of European Patent Application No. 18167178.5, dated Oct. 11, 2018.

(Continued)

*Primary Examiner* — Graham P Smith
*Assistant Examiner* — Jae K Kim
(74) *Attorney, Agent, or Firm* — Harness, Dickey & Pierce, P.L.C.; Anthony G. Fussner

(57) ABSTRACT

Exemplary embodiments are disclosed of vehicular antenna assemblies and methods relating to assembling vehicular antenna assemblies. In an exemplary embodiment, a vehicular antenna assembly generally includes a dielectric antenna carrier and at least one antenna coupled to the dielectric antenna carrier. The at least one antenna includes a lower end portion that extends downwardly relative to the dielectric antenna carrier. The lower end portion is positionable within an opening in a printed circuit board and/or positionable in electrical contact with a contact member along the printed circuit board when the dielectric antenna carrier and the at least one antenna are moved relatively downward toward the printed circuit board.

15 Claims, 22 Drawing Sheets

(51) Int. Cl.

| | |
|---|---|
| ***H01Q 11/08*** | (2006.01) |
| ***H01Q 9/36*** | (2006.01) |
| ***H01Q 5/40*** | (2015.01) |
| *H01Q 5/371* | (2015.01) |
| *H01Q 1/24* | (2006.01) |
| *H01Q 1/42* | (2006.01) |

(52) U.S. Cl.
CPC ..... *H01Q 1/36* (2013.01); *H01Q 1/368* (2013.01); *H01Q 1/38* (2013.01); *H01Q 5/40* (2015.01); *H01Q 9/36* (2013.01); *H01Q 9/42* (2013.01); *H01Q 11/08* (2013.01); *H01Q 1/12* (2013.01); *H01Q 1/241* (2013.01); *H01Q 1/42* (2013.01); *H01Q 5/371* (2015.01)

(58) Field of Classification Search
CPC ..... H01Q 1/36; H01Q 1/3275; H01Q 1/368; H01Q 9/42; H01Q 1/12; H01Q 1/42; H01Q 1/241; H01Q 5/371
See application file for complete search history.

(56) References Cited

U.S. PATENT DOCUMENTS

| | | | | |
|---|---|---|---|---|
| 8,963,786 | B2 | 2/2015 | Kowalewicz et al. | |
| 2004/0119657 | A1* | 6/2004 | Mayer | H01Q 1/362 343/906 |
| 2010/0277379 | A1* | 11/2010 | Lindackers | H01Q 1/3275 343/713 |
| 2012/0164865 | A1* | 6/2012 | Bayerer | H01R 12/585 439/345 |
| 2012/0190252 | A1* | 7/2012 | Pavlinsky | H01M 10/425 439/775 |
| 2014/0292593 | A1* | 10/2014 | Thiam | H01Q 9/0421 343/713 |
| 2015/0071137 | A1* | 3/2015 | Thiam | H04B 7/0413 370/297 |
| 2015/0288086 | A1* | 10/2015 | Tramet | H05K 3/32 439/78 |
| 2016/0064807 | A1* | 3/2016 | Reed | H01Q 1/38 343/713 |
| 2016/0118719 | A1* | 4/2016 | Shirley | H01Q 23/00 343/700 MS |
| 2019/0006733 | A1* | 1/2019 | Yasin | H01Q 1/3275 |

OTHER PUBLICATIONS

European Office Action for EP Application No. 18167178.5 which claims priority to the instant application, dated Feb. 12, 2020, 10 pages.

* cited by examiner

VEHICULAR ANTENNA ASSEMBLIES

CROSS-REFERENCE TO RELATED APPLICATION

This application claims the benefit of and priority to U.S. Provisional Patent Application No. 62/526,900 filed Jun. 29, 2017 and U.S. Provisional Patent Application No. 62/532,751 filed Jul. 14, 2017. The entire disclosures of the above applications are incorporated herein by reference.

FIELD

The present disclosure generally relates to vehicular antenna assemblies.

BACKGROUND

This section provides background information related to the present disclosure which is not necessarily prior art.

Various different types of antennas are used in the automotive industry, including AM/FM radio antennas, Satellite Digital Audio Radio Service (SDARS) antennas (e.g., SiriusXM satellite radio, etc.), Global Navigation Satellite System (GNSS) antennas, cellular antennas, WiFi antennas, etc. Multiband antenna assemblies are also commonly used in the automotive industry. A multiband antenna assembly typically includes multiple antennas to cover and operate at multiple frequency ranges. A printed circuit board (PCB) having radiating antenna elements is a typical component of the multiband antenna assembly.

An antenna assembly may be installed or mounted on a vehicle surface, such as the roof, trunk, or hood of the vehicle to help ensure that the antennas have unobstructed views overhead or toward the zenith. The antenna assembly may be connected (e.g., via a coaxial cable, etc.) to one or more electronic devices (e.g., a radio receiver, a touchscreen display, navigation device, cellular phone, etc.) inside the passenger compartment of the vehicle, such that the antenna assembly is operable for transmitting and/or receiving signals to/from the electronic device(s) inside the vehicle.

FIG. 1 illustrates a conventional vehicular antenna assembly 11 including a vertical printed circuit board (PCB) antenna 15. As shown, the PCB antenna 15 includes AM/FM/DAB elements (e.g., electrically-conductive traces, printed spiral pattern, etc.) on the PCB substrate 19. The PCB antenna 15 is soldered to a principal PCB 21, which, in turn, is supported by a base or chassis 25 of the antenna assembly 11. The soldering helps assure both mechanical fixation and electrical conductivity between the PCB antenna 15 and the principal PCB 21. For example, the electrically-conductive trace 29 extends from the electrically-conductive traces 33 and is soldered to the PCB 21 for electrically connecting the traces 33 to the PCB 21. Also shown in FIG. 1 are PCB holders or supports 37 that may be soldered for helping to mechanically support and couple the PCB antenna 15 to the PCB 21. A capacitive loading element or plate 41 is along an upper portion of the PCB antenna 15.

DRAWINGS

The drawings described herein are for illustrative purposes only of selected embodiments and not all possible implementations, and are not intended to limit the scope of the present disclosure.

Figure 2:
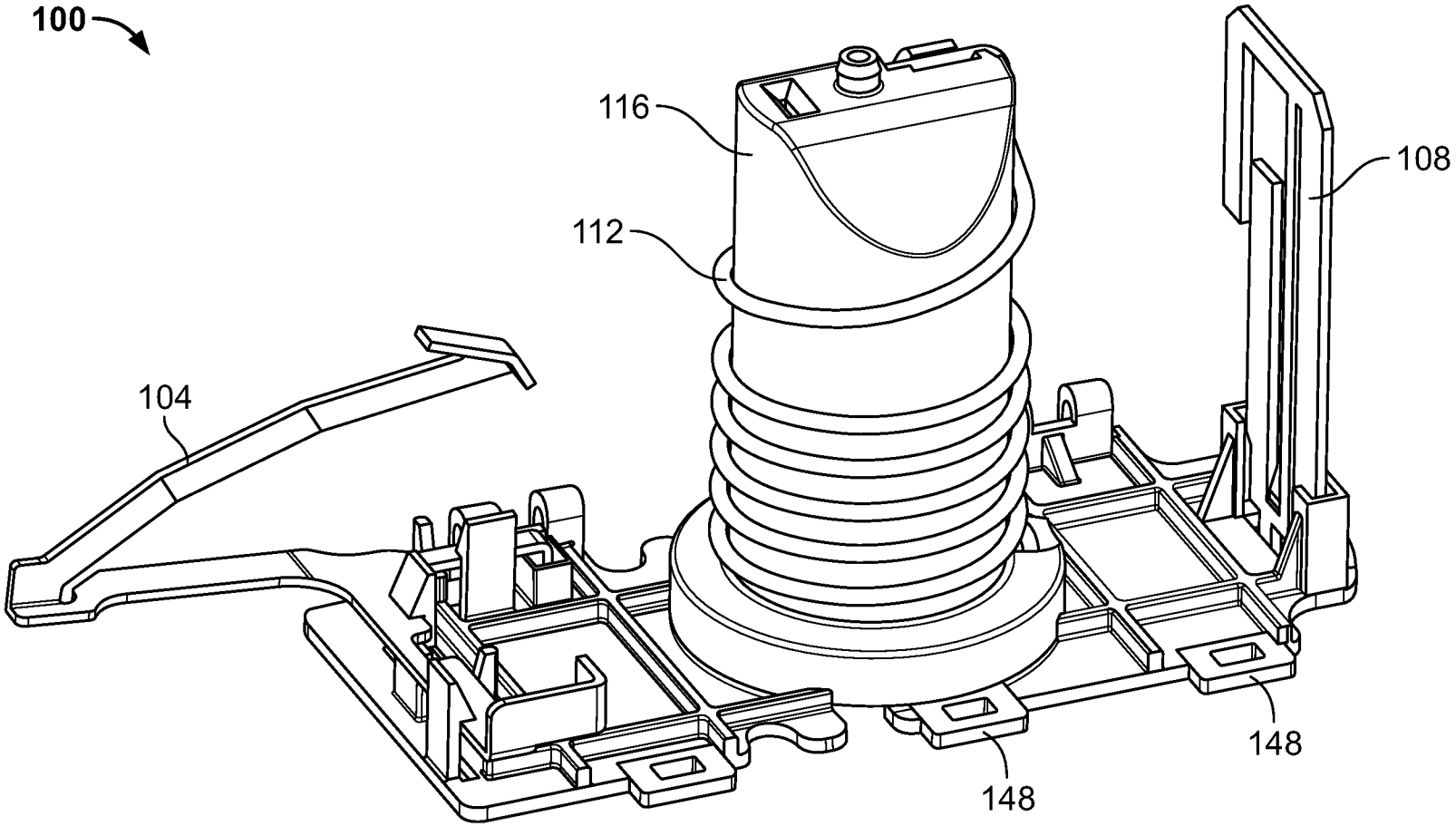
FIGS. 2 and 3 are perspective views illustrating an AM/FM/DAB antenna and first and second (or primary and secondary) cellular antennas coupled to and/or supported by an antenna carrier of a vehicular antenna assembly according to an exemplary embodiment.
Figure 3:
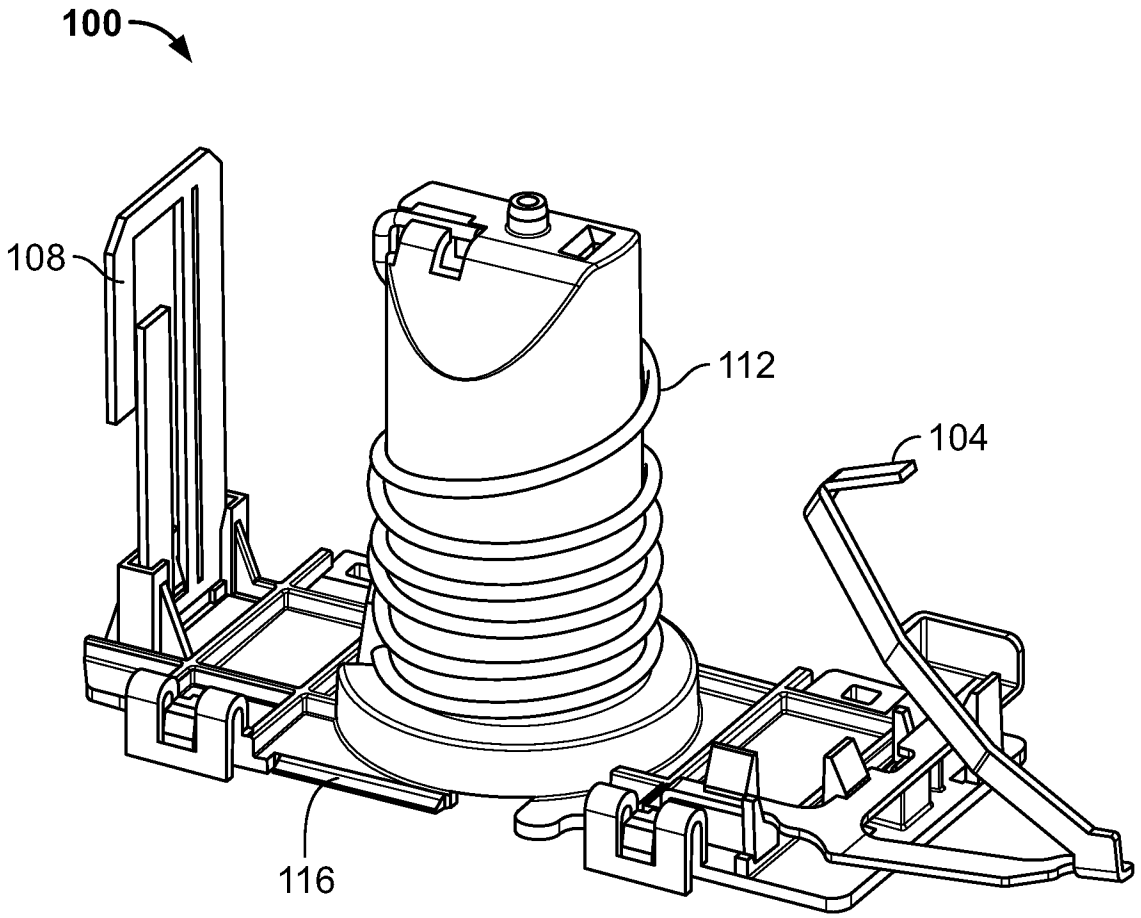
Figure 4:
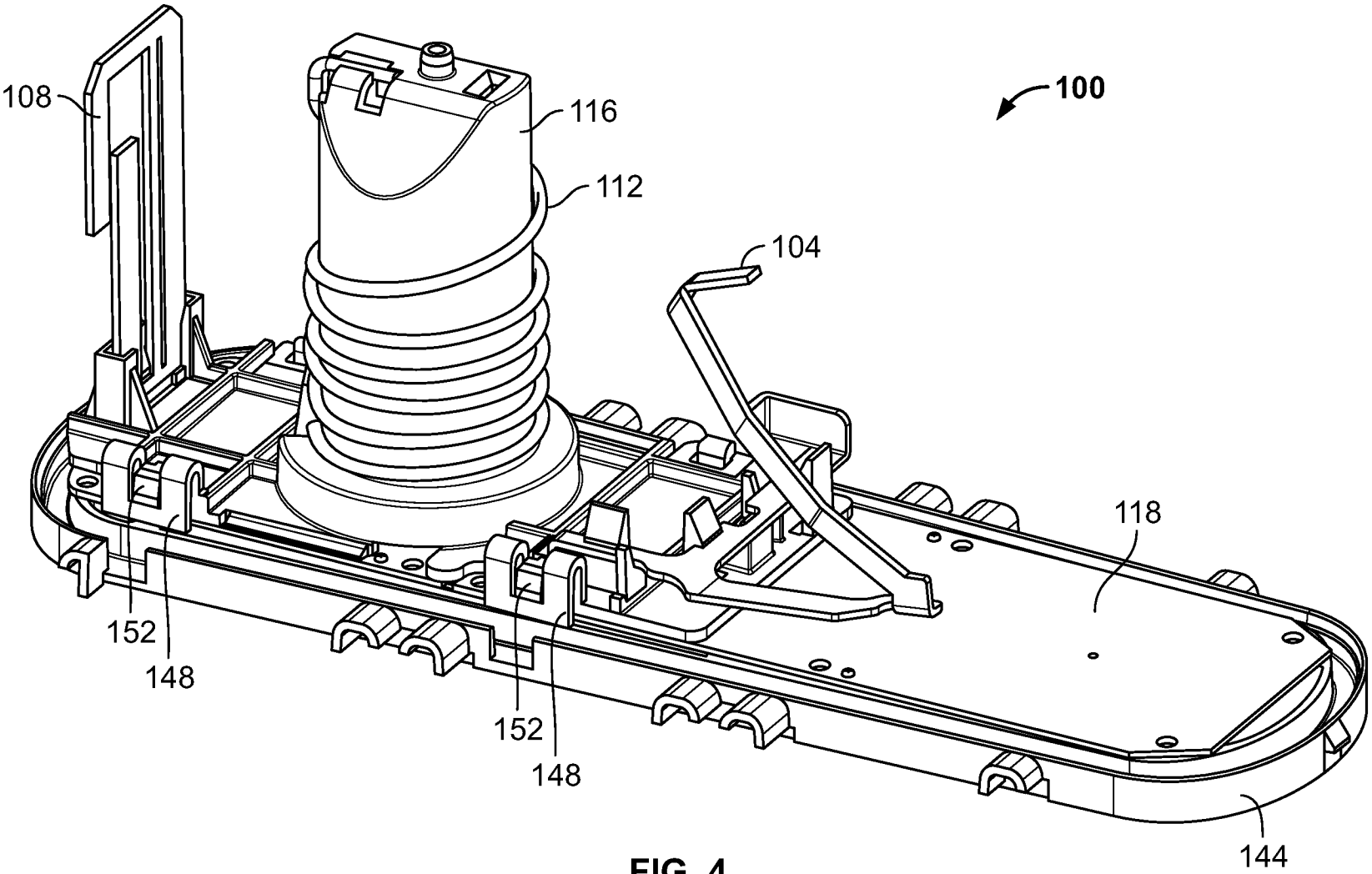
Figure 5:
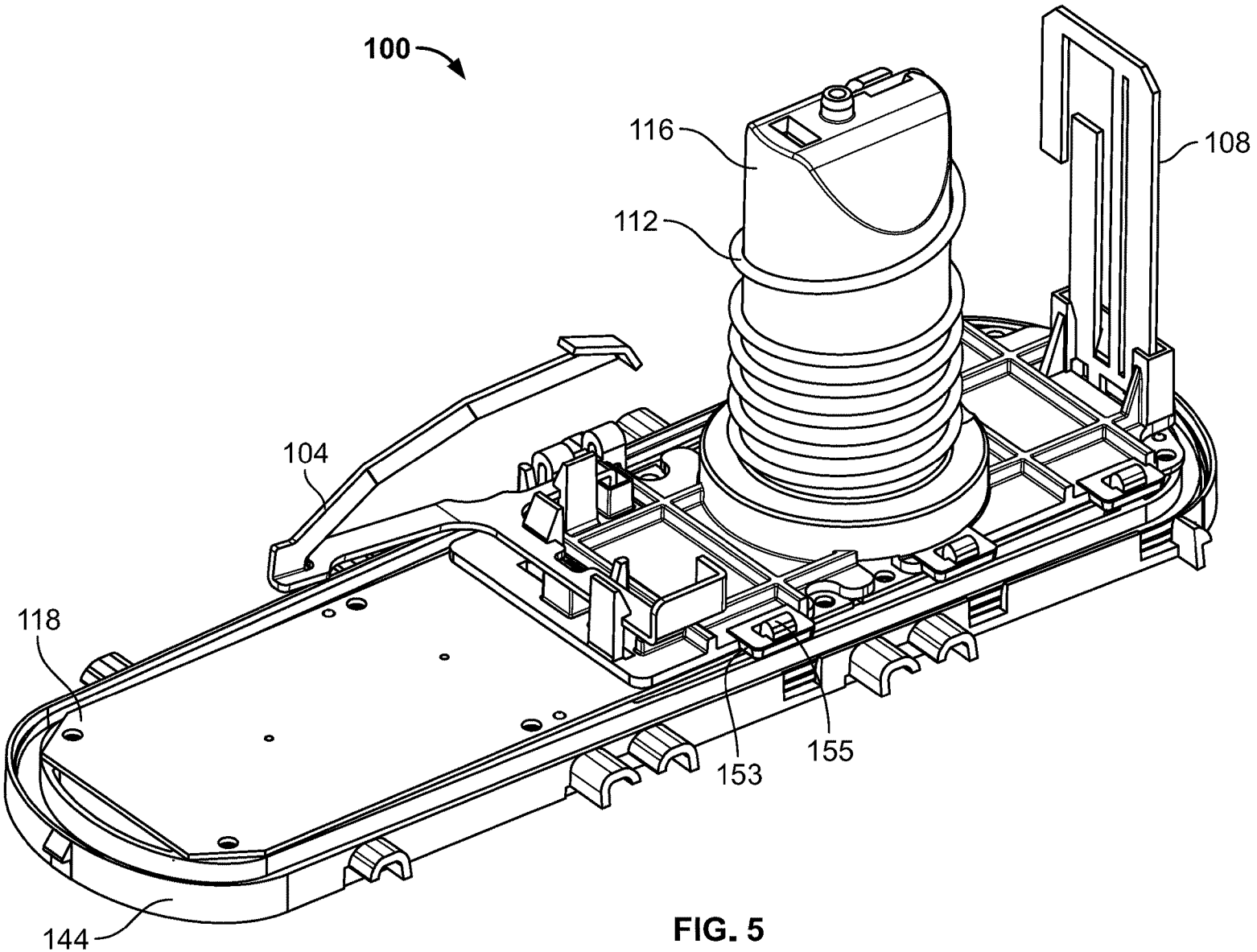
Figure 6:
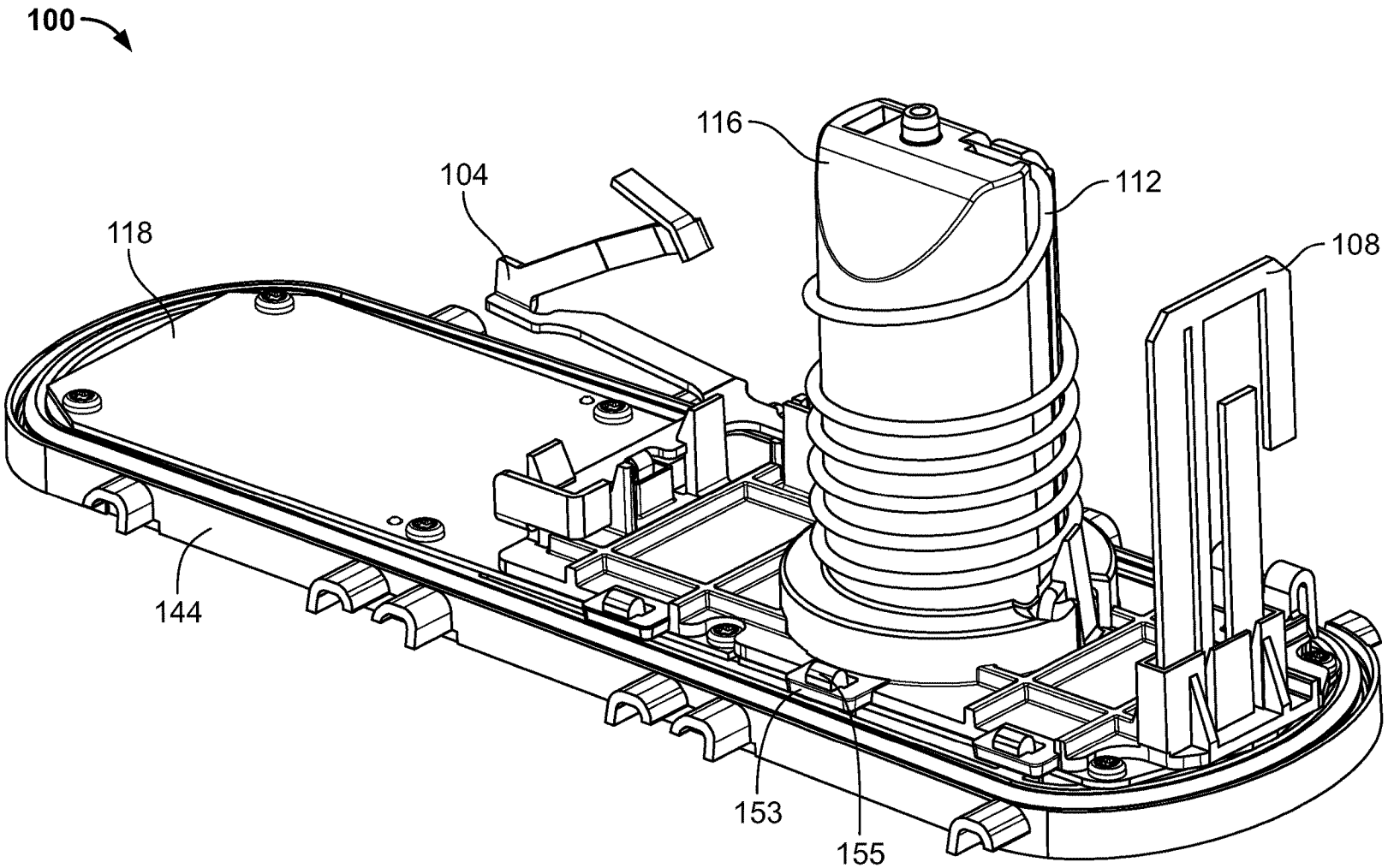
Figure 7:
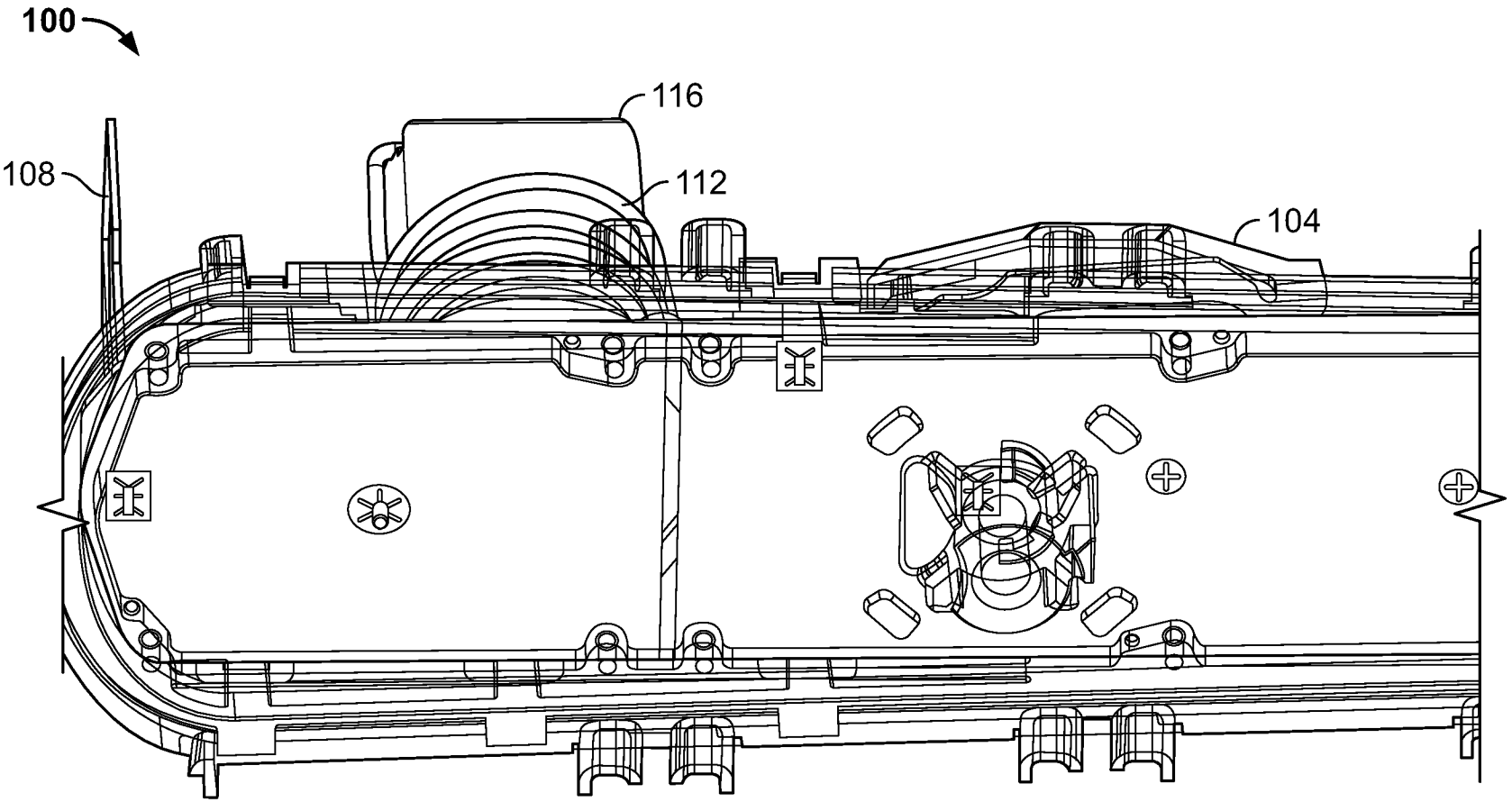
Figure 8:
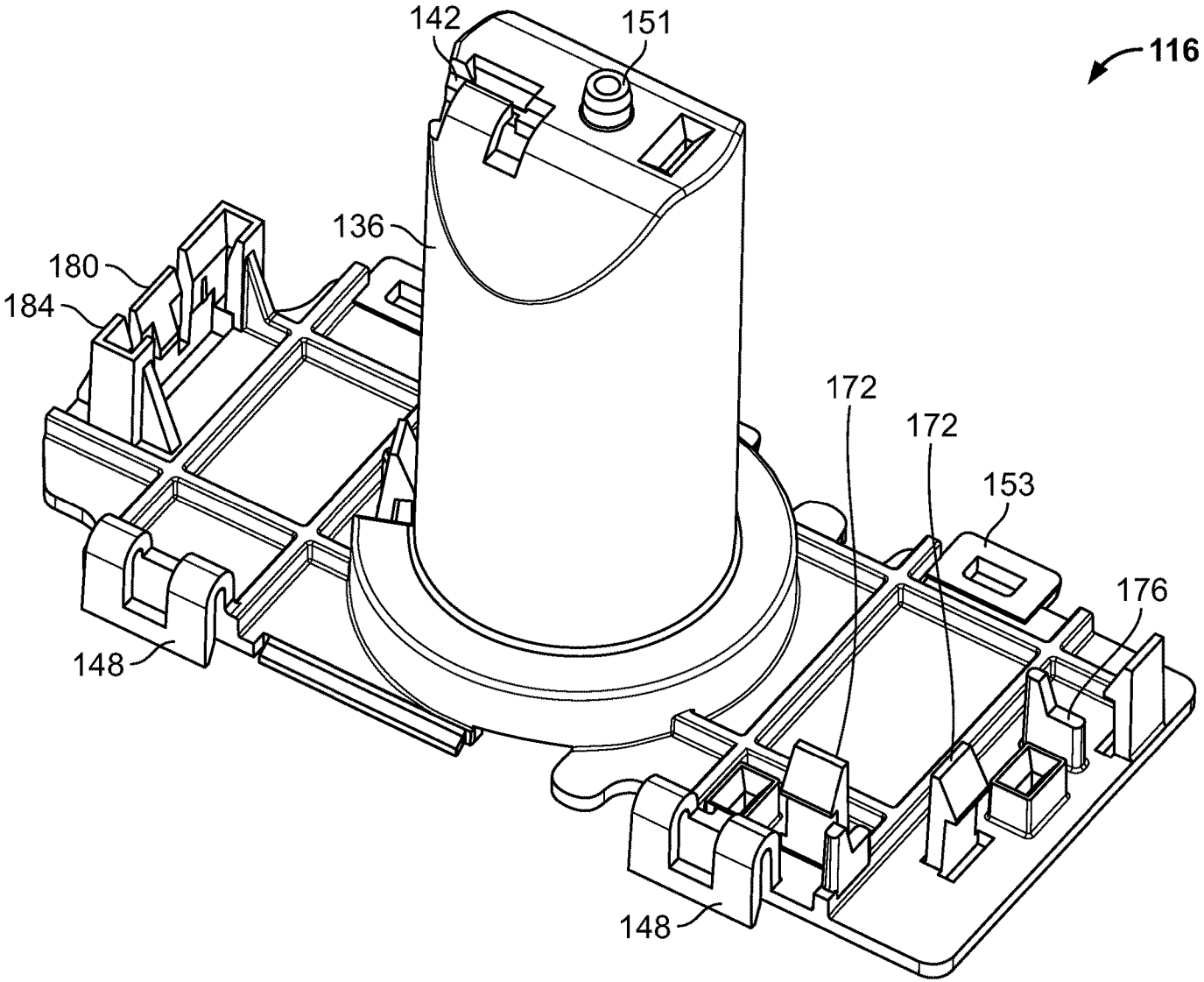
Figure 9:
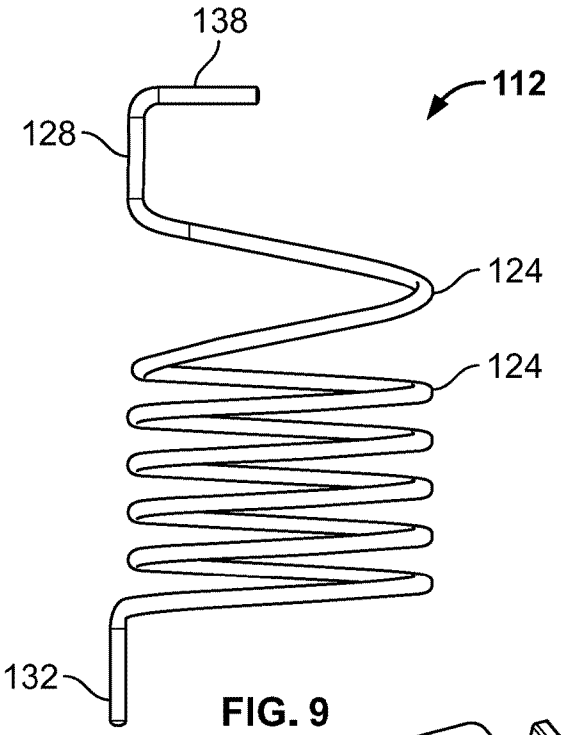
Figure 10:
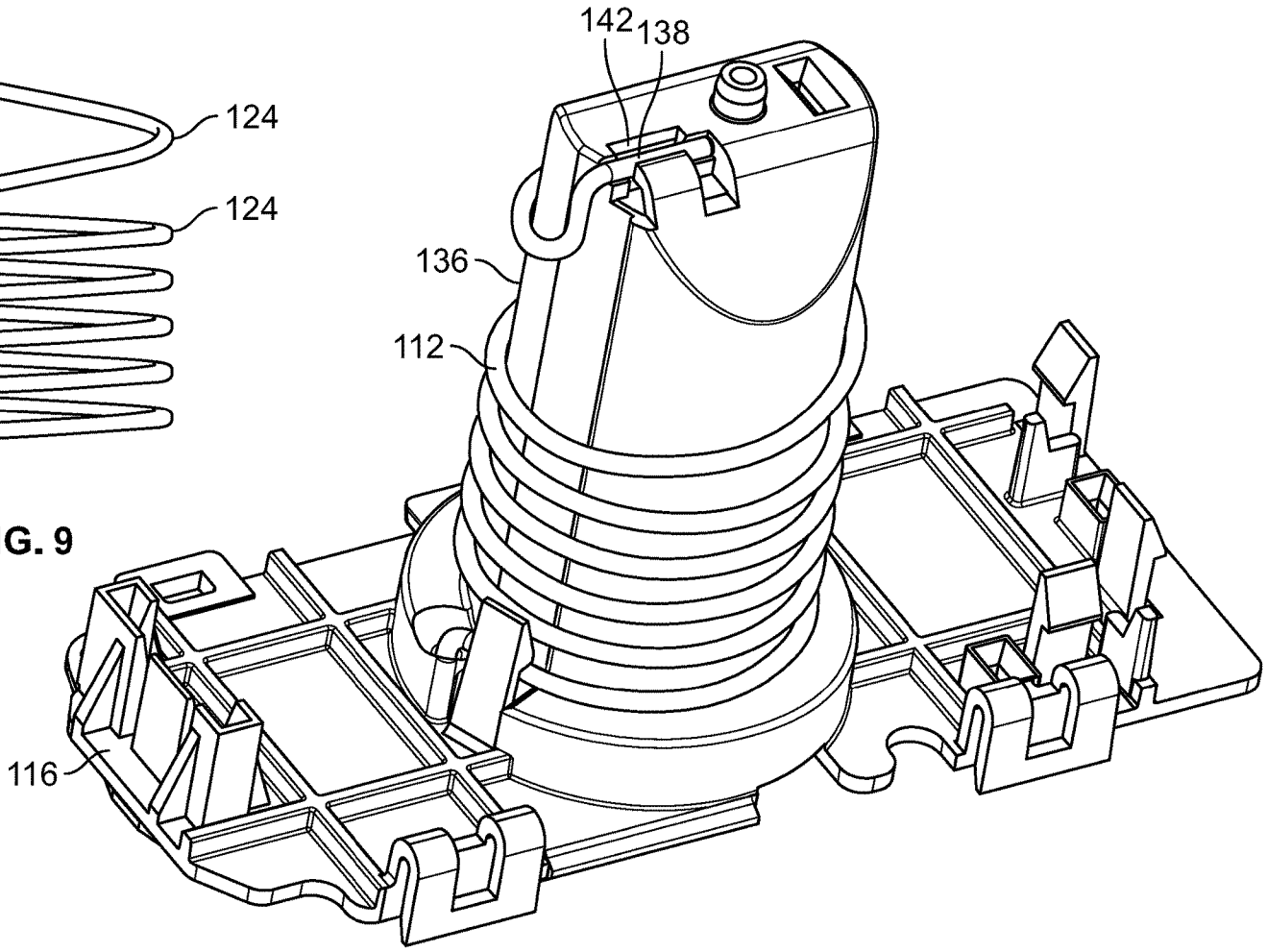
Figure 11:
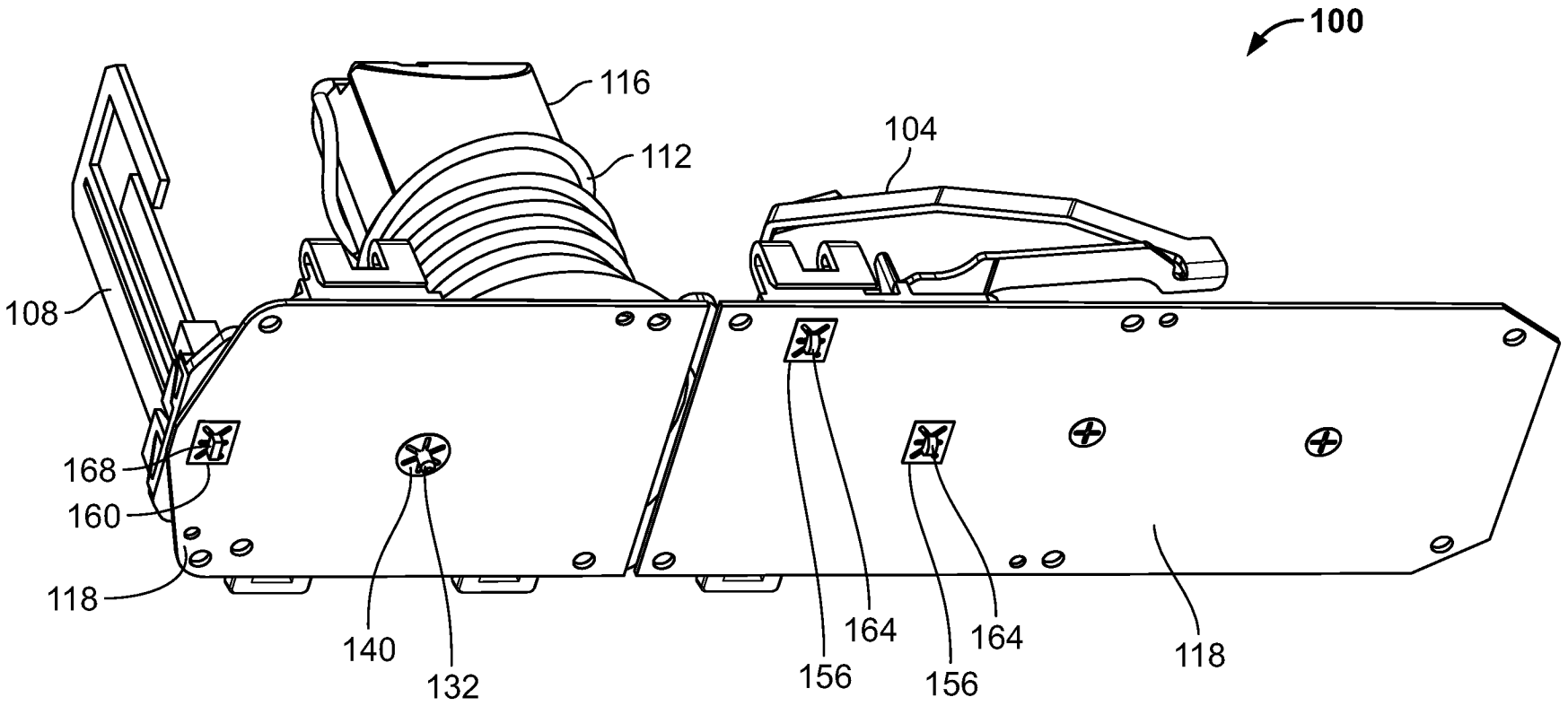
Figures 12A, 12B, 12C:
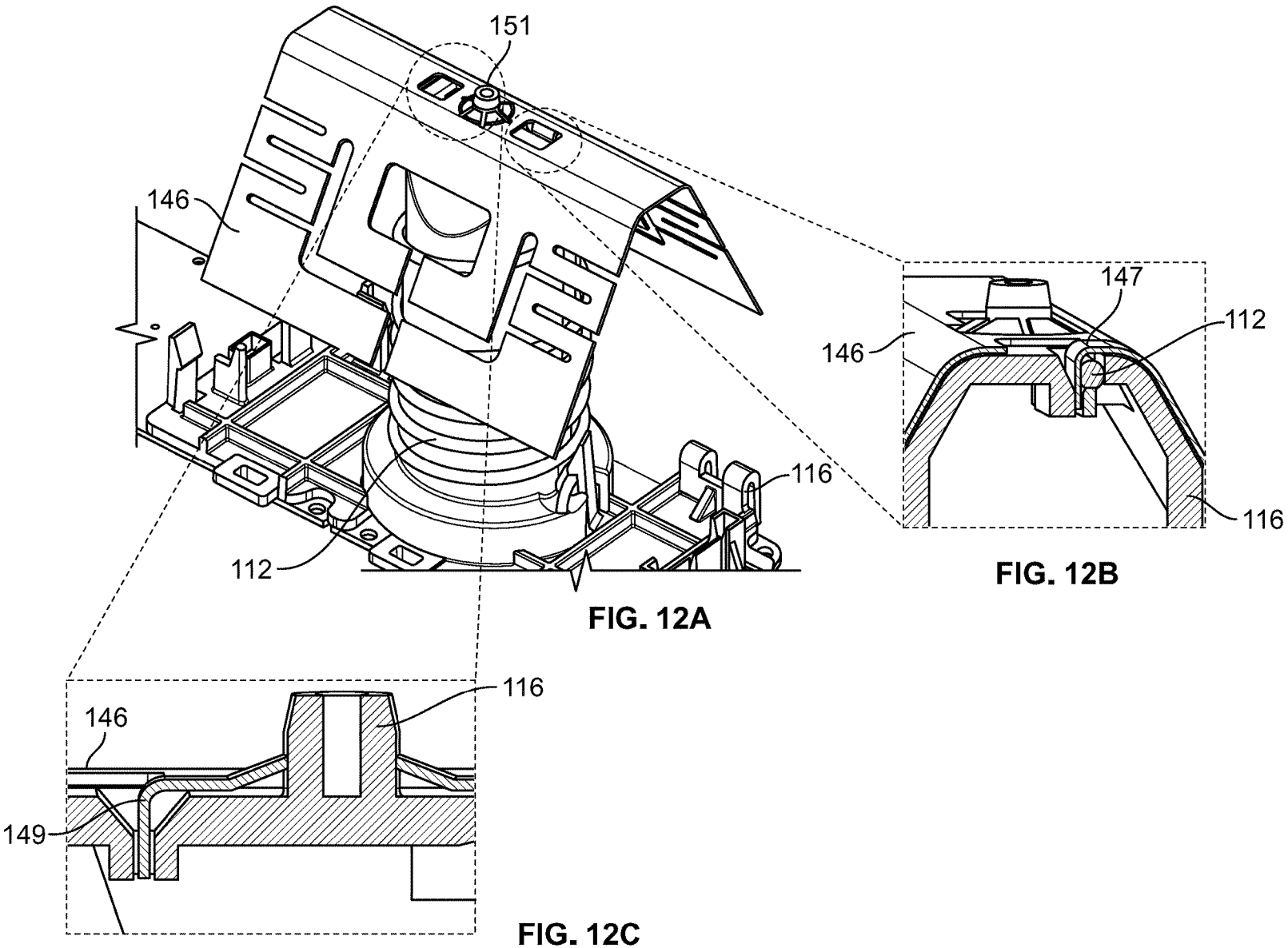
Figure 13:
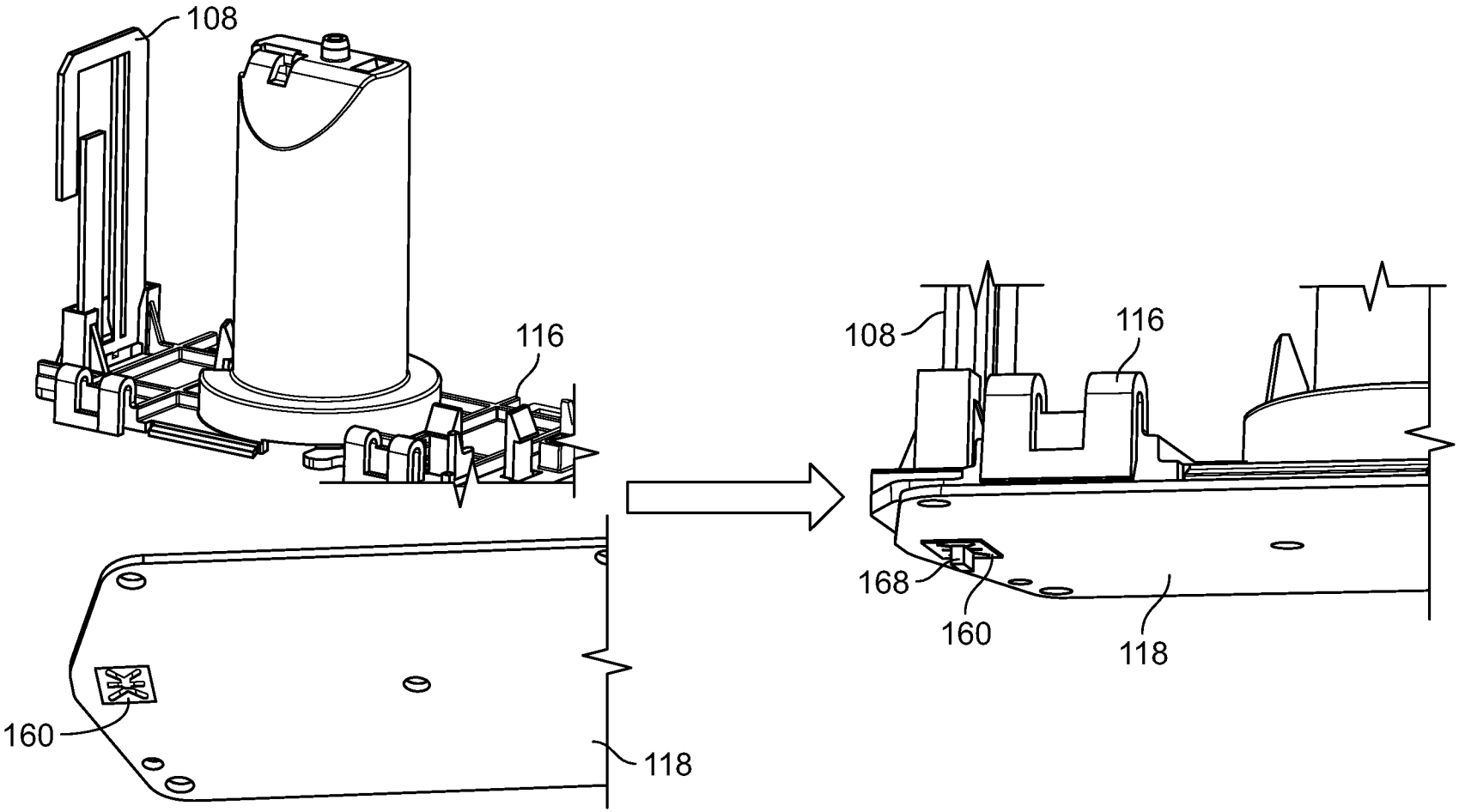
Figure 14:
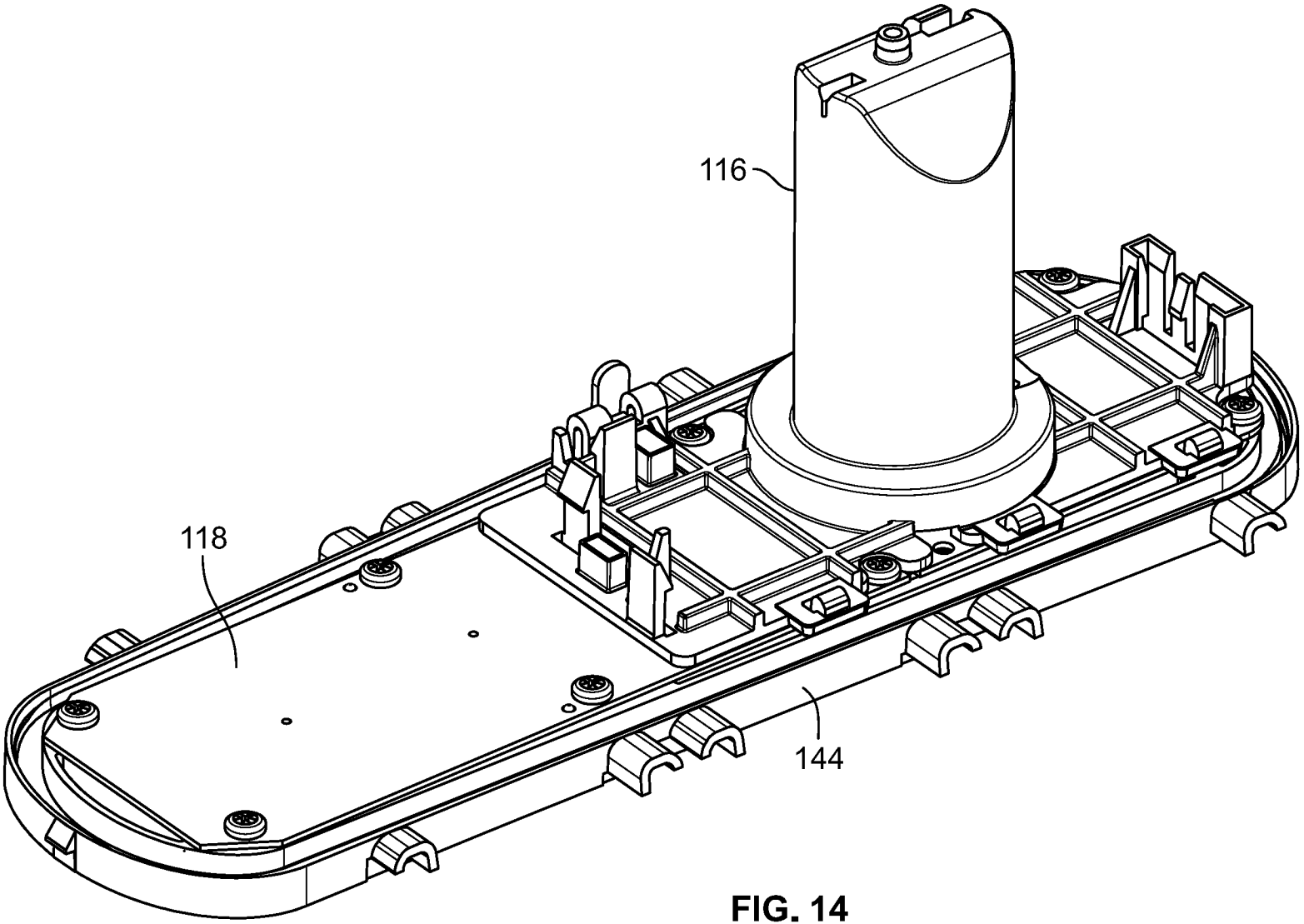
Figure 15:
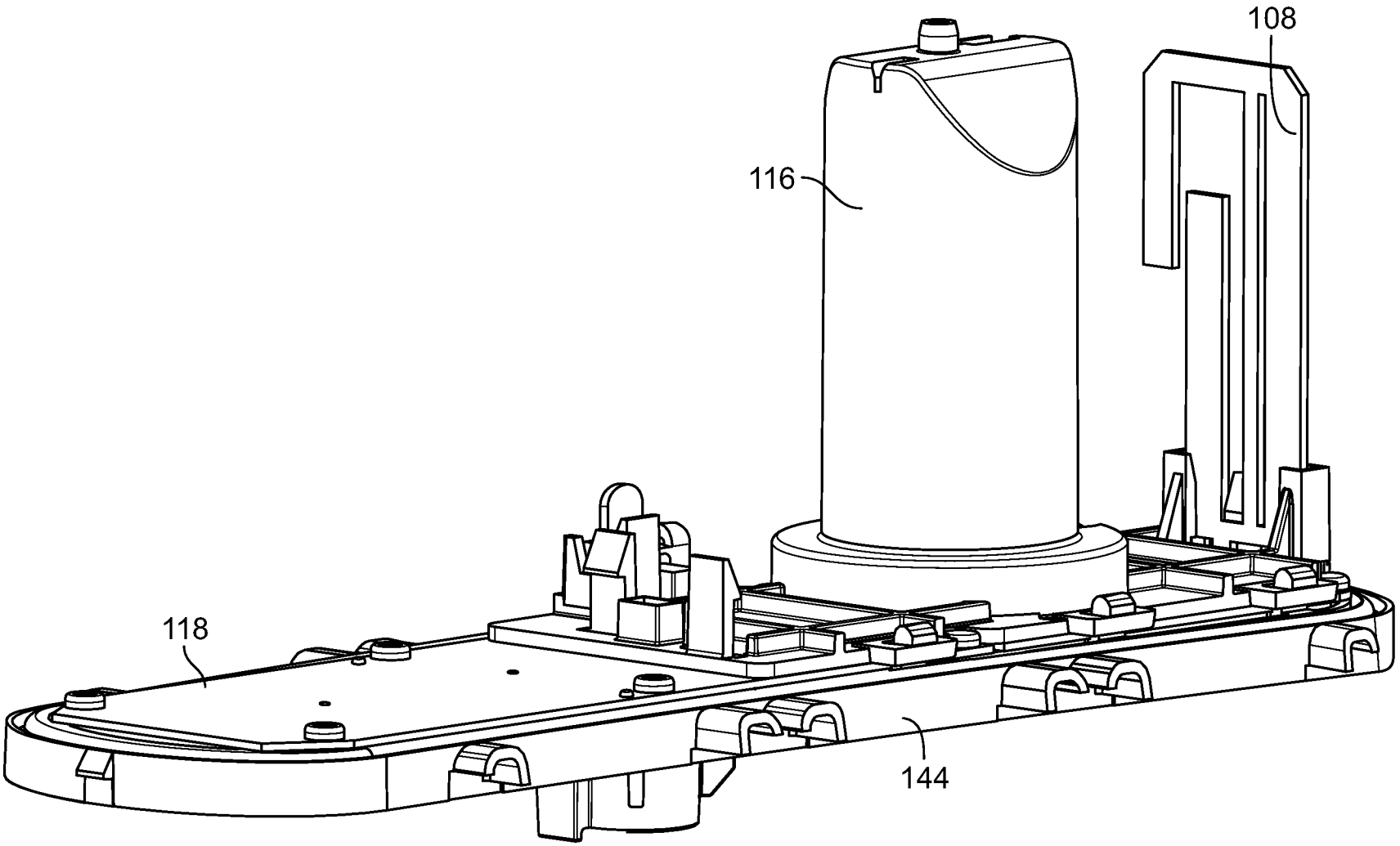
Figure 16:
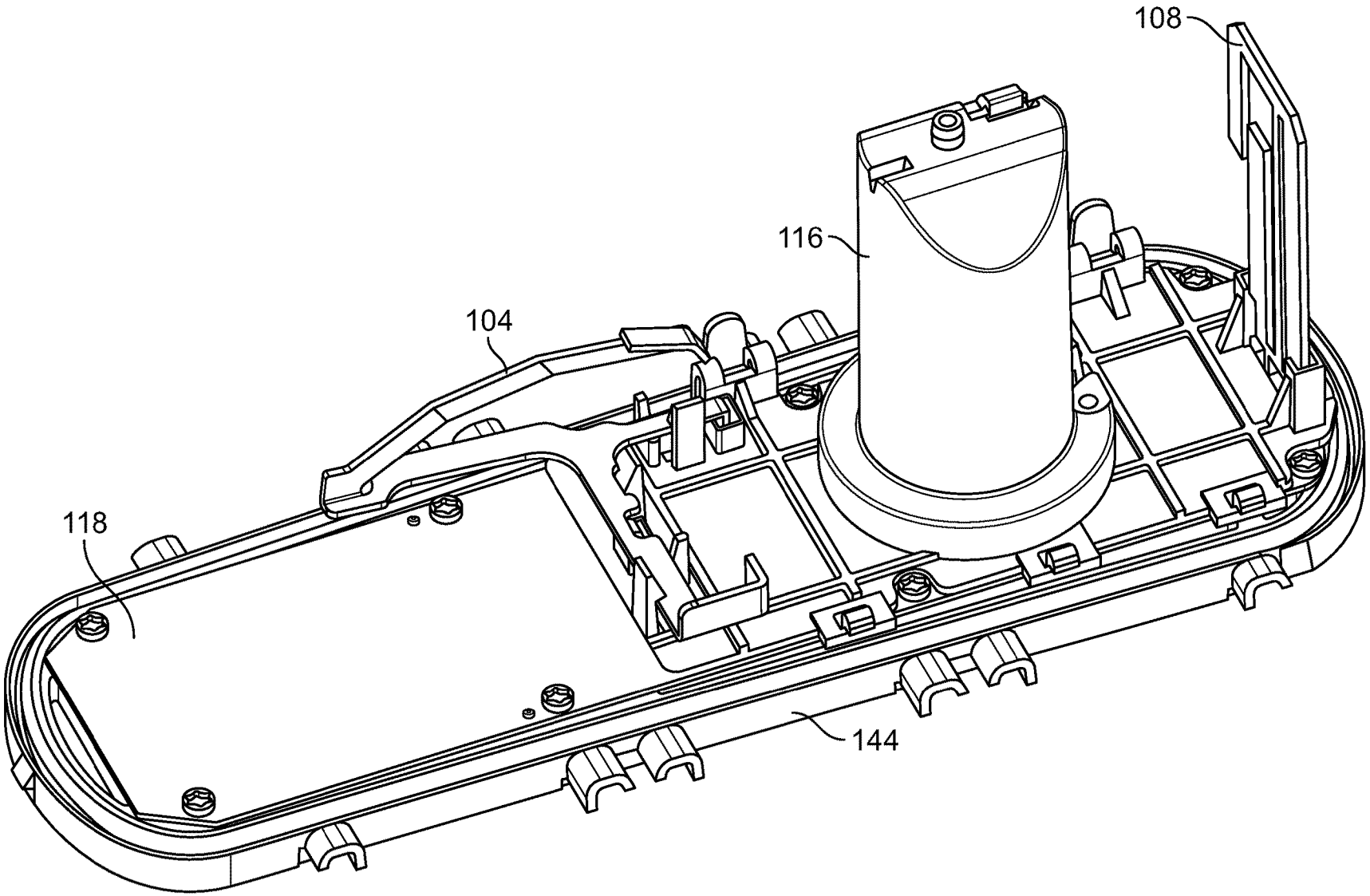
Figure 17:
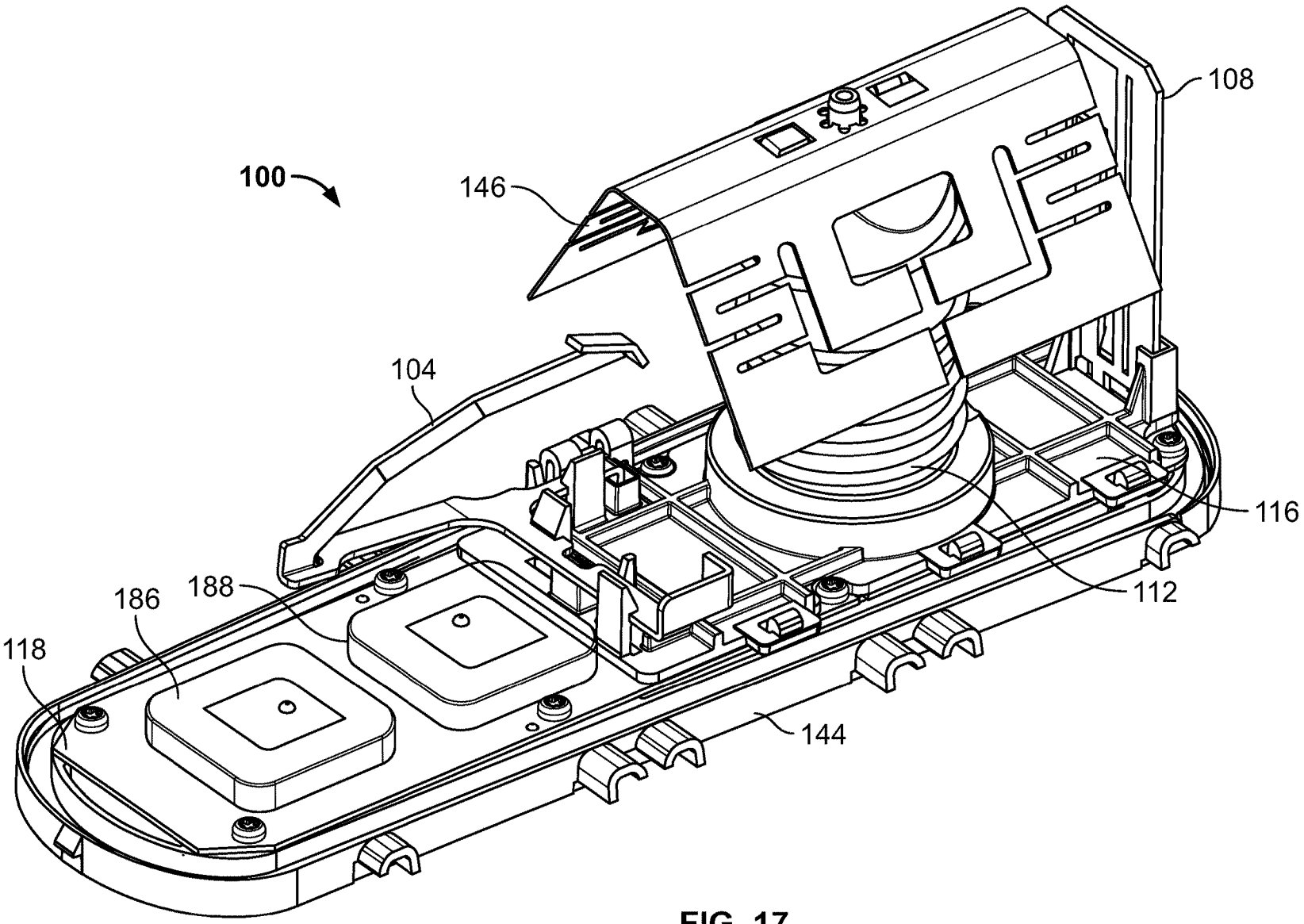
Figure 18:
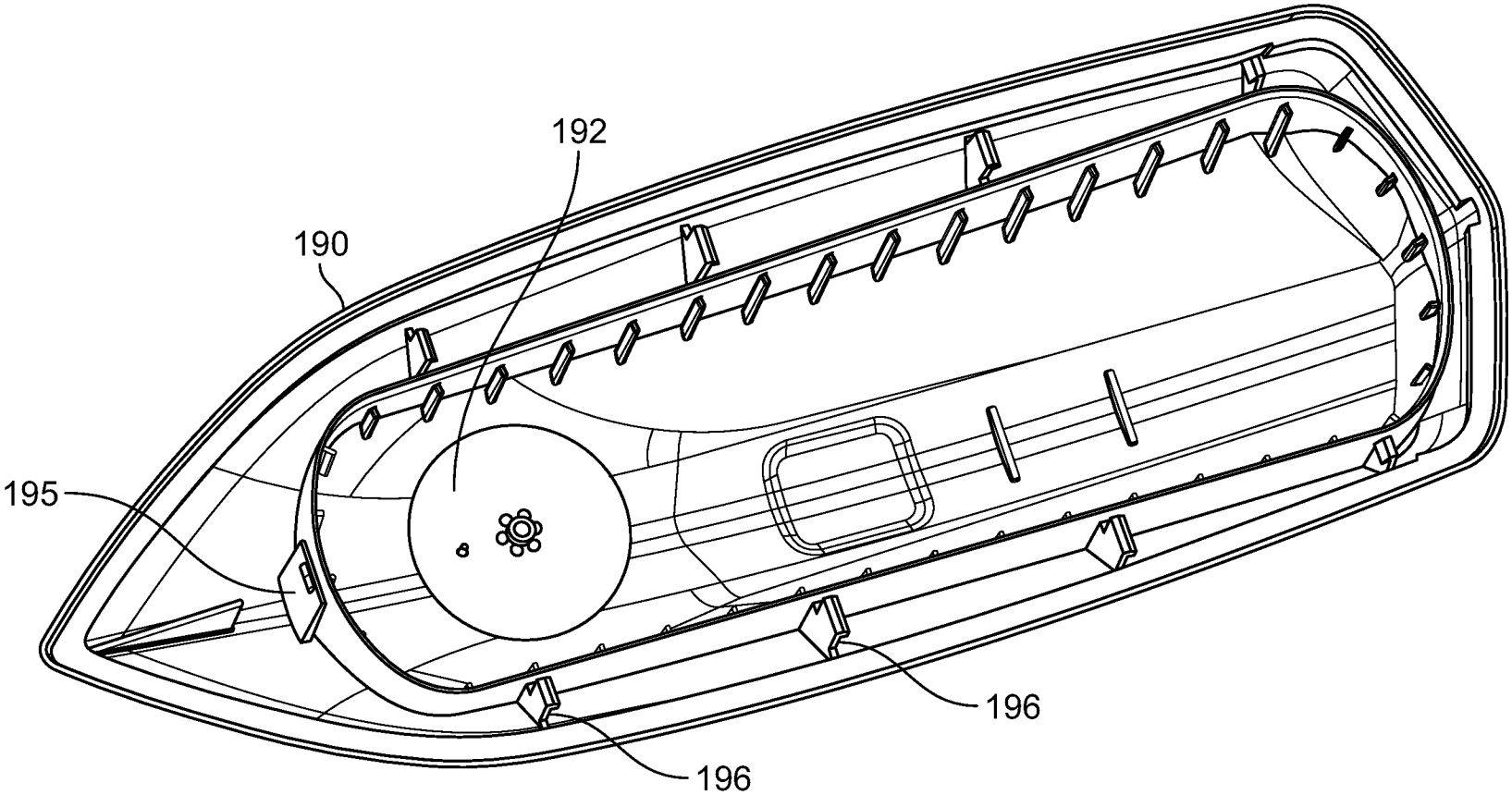
Figures 19A, 19B, 19C:
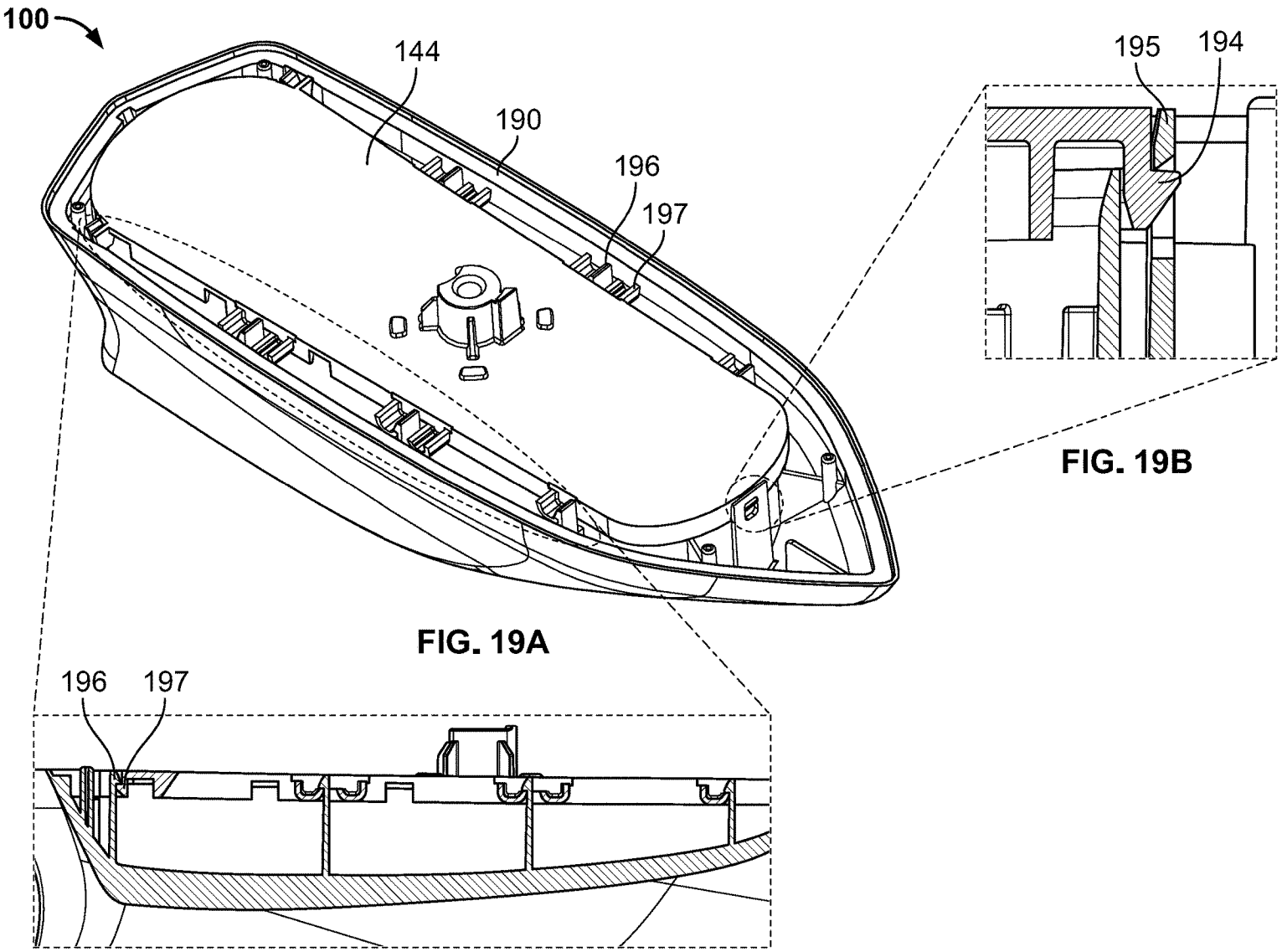
Figure 20:
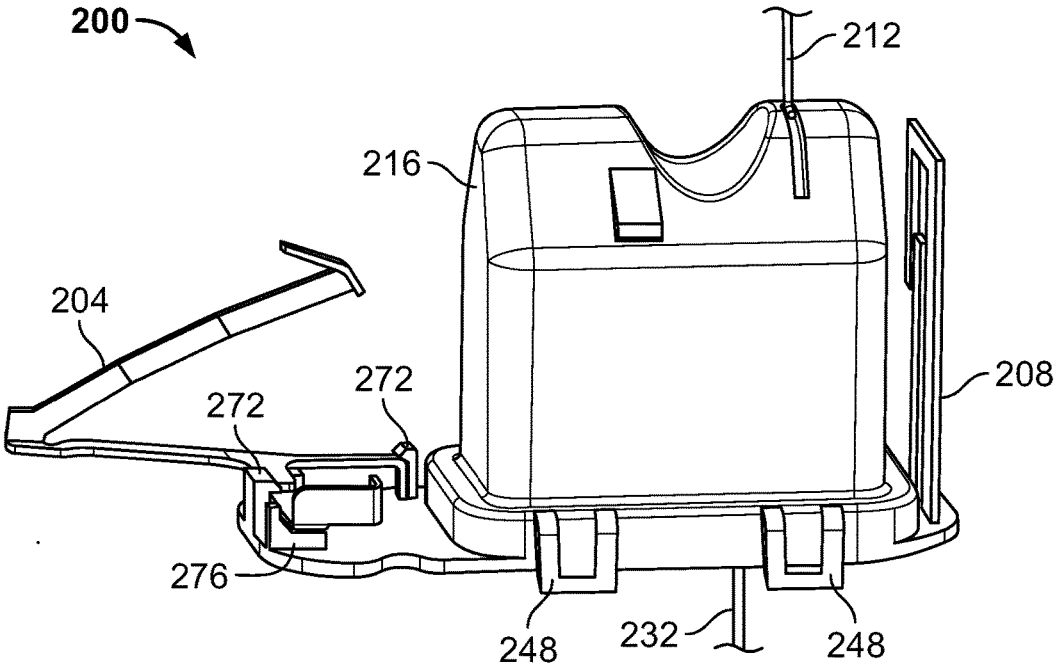
Figure 21:
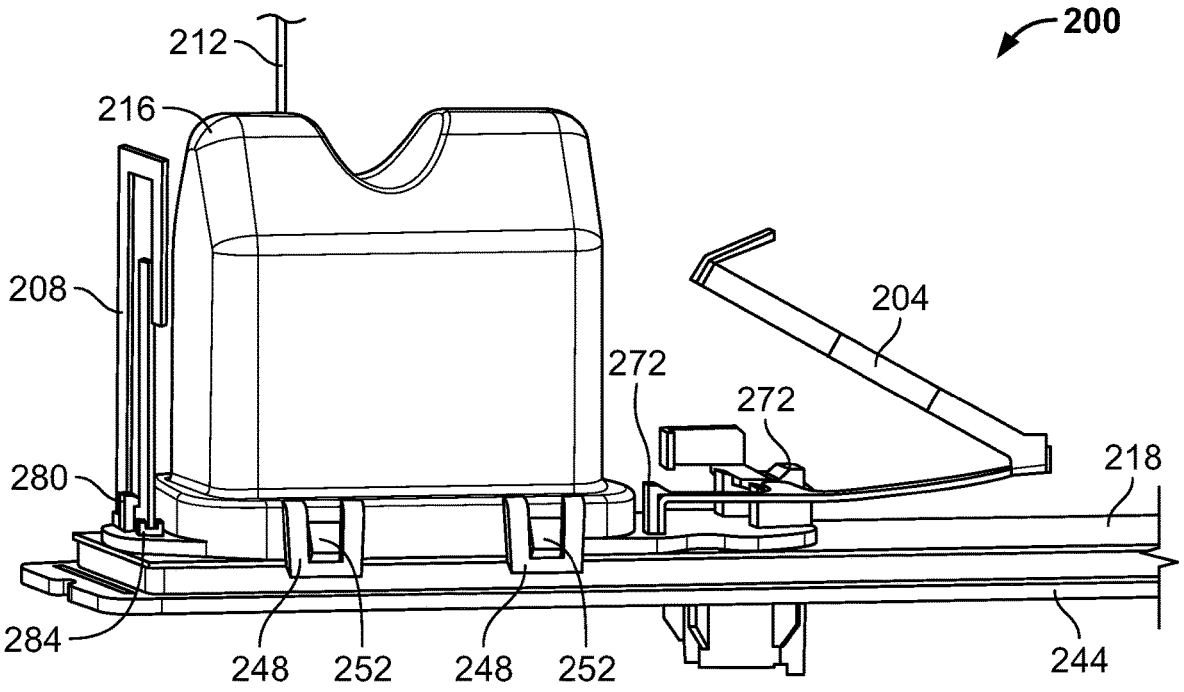
Figure 22:
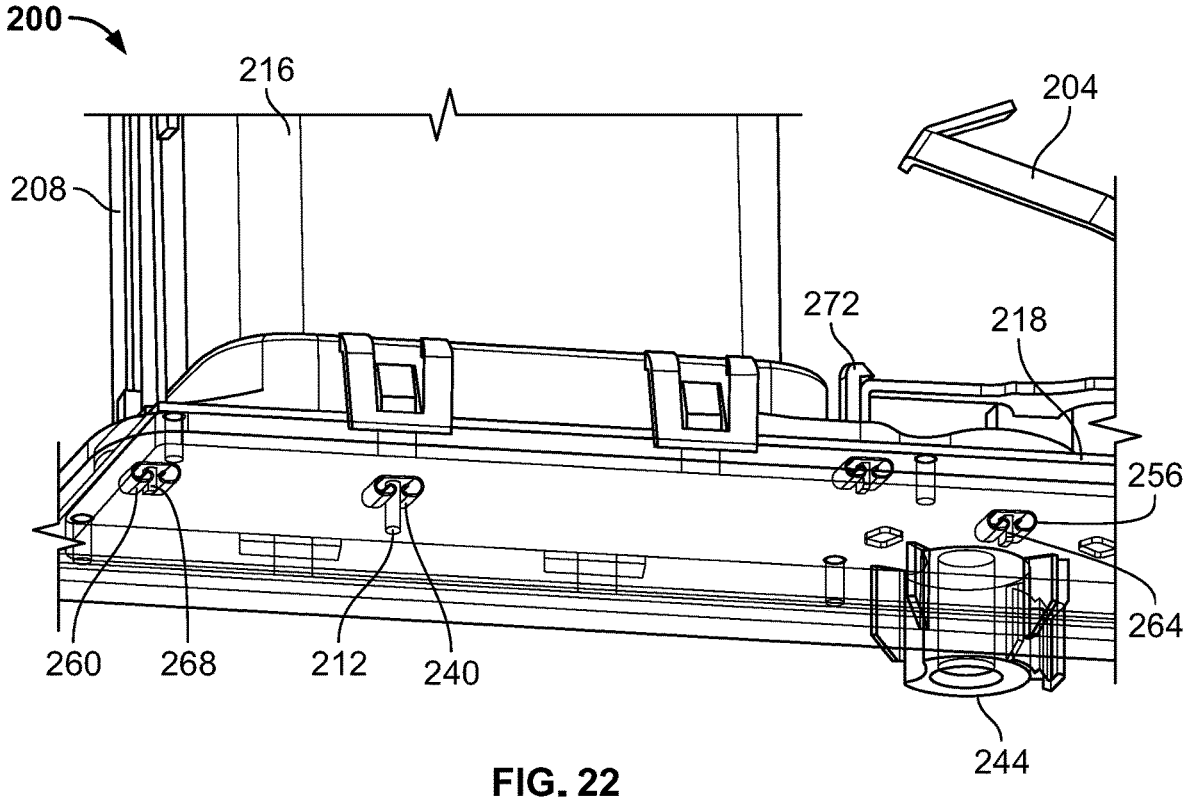
Figure 23:
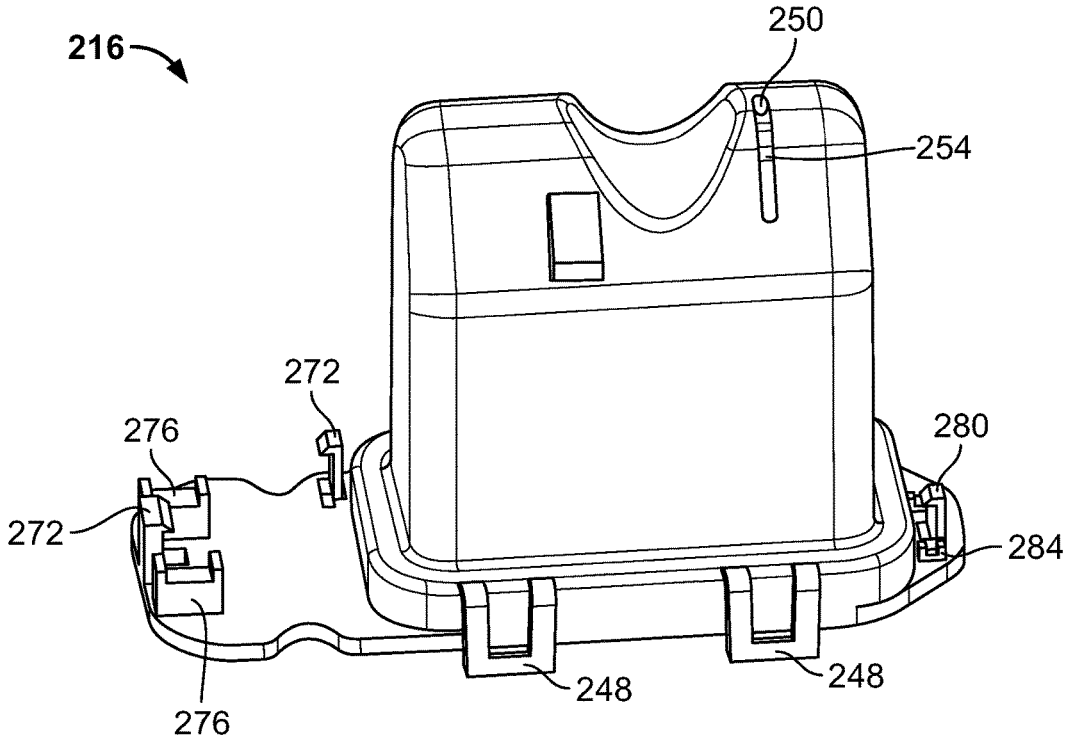
Figure 25:
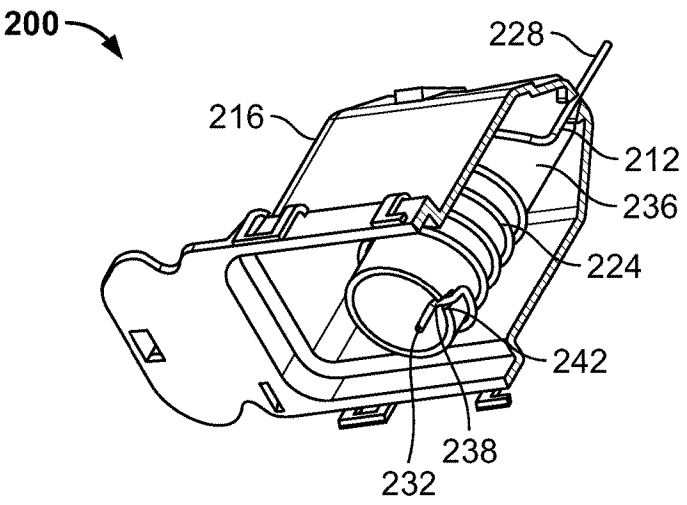
Figure 24:
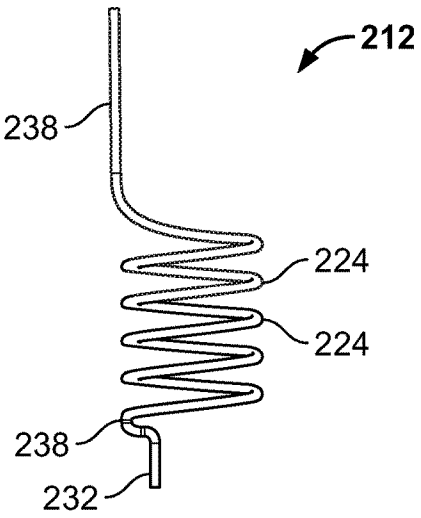
Figure 27:
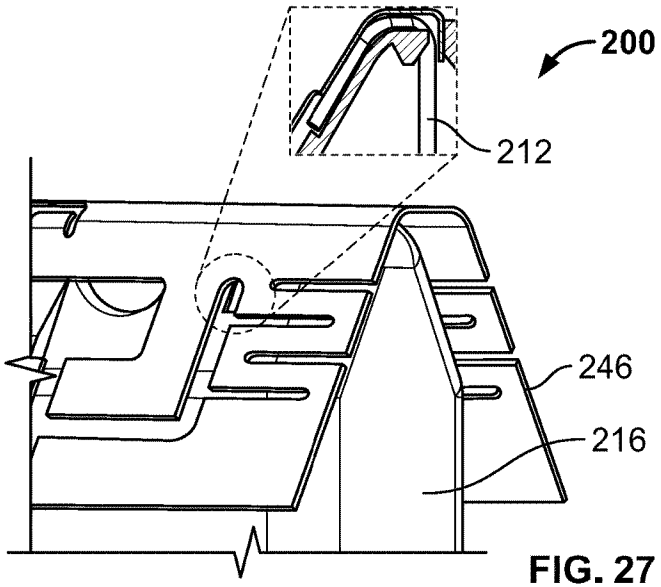
Figure 26:
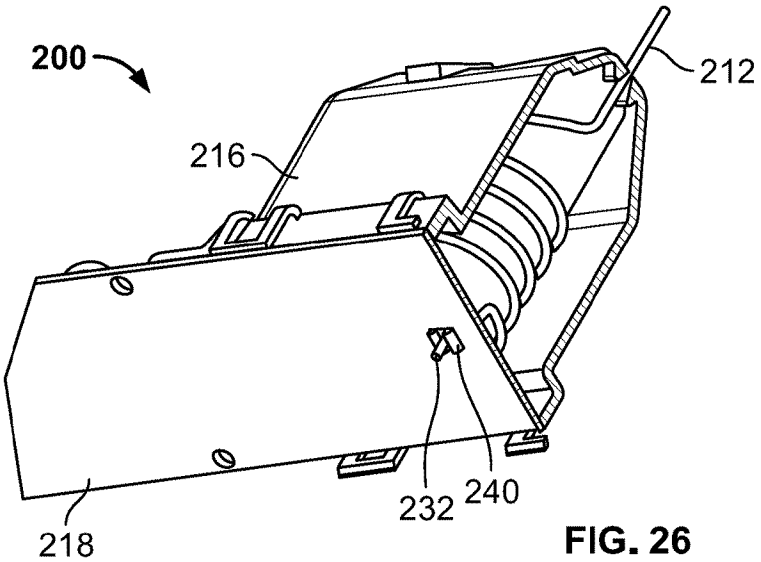
Figure 28:
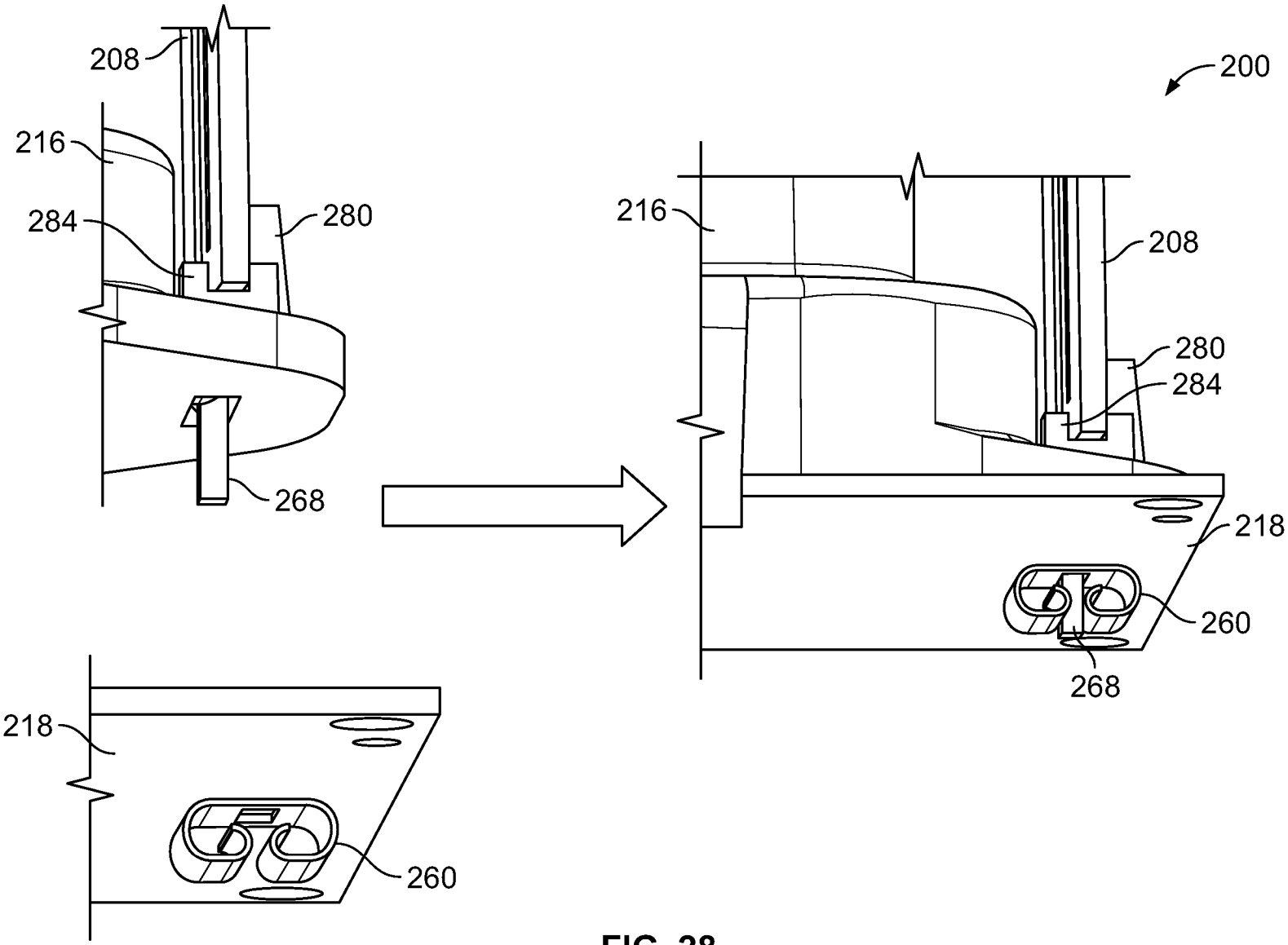

FIGS. 4, 5, and 6 are perspective views illustrating the antenna carrier shown in FIGS. 2 and 3 positioned on a printed circuit board (PCB) and coupled with (e.g., snap clipped, snap fit, latched onto, etc.) a chassis or base of the vehicular antenna assembly according to an exemplary embodiment;

FIG. 7 is a perspective view illustrating contacts (e.g., SMT (surface-mount technology) mounted spring contact clips, etc.) along a bottom side of the PCB shown in FIGS. 4, 5, and 6 and electrically connected with lower portions of the AM/FM/DAB antenna and the primary and secondary cellular antennas of the vehicle antenna assembly according to an exemplary embodiment, where the base or chassis is shown transparent to illustrate the electrical connections between the contacts and the lower portions of the antennas;

FIG. 8 is a perspective view of the antenna holder shown in FIGS. 2 through 7;

FIG. 9 is a side view of the AM/FM/DAB antenna shown in FIGS. 2 through 7;

FIG. 10 is a perspective view illustrating the AM/FM/DAB antenna shown in FIG. 9 supported by and/or mounted to (e.g., coiled about, etc.) the antenna carrier shown in FIG. 8;

FIG. 11 is a perspective view illustrating the lower end portions of the antennas shown in FIGS. 2 through 7 protruding downward through corresponding openings in the PCB and openings in the contacts (e.g., SMT (surface-mount technology) mounted spring contact clips, etc.) along the bottom side of the PCB, to thereby electrically connect the lower antenna portions with the PCB via the contacts according to an exemplary embodiment;

FIG. 12A is a perspective view illustrating an electrically-conductive canopy or capacitive loading element positioned overtop the antenna carrier and AM/FM/DAB antenna shown in FIG. 10, and illustrating an upwardly extending portion (e.g., post, alignment pin, etc.) of the antenna carrier extending through an opening in the canopy according to an exemplary embodiment;

FIG. 12B is a perspective view of a portion of the antenna carrier, AM/FM/DAB antenna, and canopy shown in FIG. 12A, and illustrating a first downwardly extending portion (e.g., a first bent tab, etc.) of the canopy in electrically contact with an upper end portion of the AM/FM/DAB antenna according to an exemplary embodiment;

FIG. 12C illustrates a portion of the antenna carrier and canopy shown in FIG. 12A, and illustrating a second downwardly extending portion (e.g., a second bent tab, etc.) of the canopy within a groove or slot along an upper portion of the antenna carrier according to an exemplary embodiment;

FIG. 13 is a perspective view illustrating the secondary cellular antenna held within or by a holder or structure of the antenna carrier shown in FIGS. 2 through 4, and also illustrating the lower portion of the secondary cellular antenna electrically connected to the PCB via a contact (e.g., SMT mounted spring contact clip, etc.) along the bottom side of the PCB;

FIG. 14 is a perspective view illustrating the antenna carrier, PCB, and chassis or base shown in FIGS. 4 through 6;

FIGS. 15 and 16 are perspective views illustrating the antenna carrier, PCB, and chassis or base shown in FIG. 14, and also illustrating the second cellular antenna shown in FIG. 13;

FIG. 17 is a perspective view illustrating the AM/FM/DAB antenna, the first and second cellular antennas, the antenna carrier, the PCB, and the chassis or base shown in FIGS. 4 through 6, and also showing the electrically-conductive canopy shown in FIG. 12A and exemplary patch antennas (e.g., GNSS patch, SDARS patch antenna, etc.) according to an exemplary embodiment;

FIG. 18 is a perspective view of an exemplary radome and a reflector internally mounted under or within the radome, where the radome is positionable over the antenna assembly shown in FIG. 17 with the reflector positioned above the forward patch antenna (e.g., SDARS patch antenna, etc.) according to an exemplary embodiment;

FIG. 19A is a perspective view illustrating the radome shown in FIG. 18 positioned over the antenna assembly shown in FIG. 17;

FIGS. 19B and 19C are perspective views showing the exemplary manner that the radome shown in FIG. 19A may be coupled with (e.g., snap clipped, snap fit, latched, etc.) the chassis or base shown in FIG. 18 according to an exemplary embodiment;

FIG. 20 is a perspective view illustrating an AM/FM/DAB antenna and first and second (or primary and secondary) cellular antennas coupled to and/or supported by an antenna carrier of a vehicular antenna assembly according to an exemplary embodiment;

FIG. 21 is a perspective view illustrating the antenna carrier shown in FIG. 20 positioned on a printed circuit board (PCB) and coupled with (e.g., snap clipped, snap fit, latched, etc.) a chassis or base of the vehicular antenna assembly according to an exemplary embodiment;

FIG. 22 is a perspective view illustrating contacts (e.g., SMT (surface-mount technology) mounted contact clips, etc.) along the bottom side of the PCB shown in FIG. 21 and electrically connected with lower portions of the AM/FM/DAB antenna and the primary and secondary cellular antennas of the vehicle antenna assembly according to an exemplary embodiment, where the base or chassis is shown transparent to illustrate the electrical connections between the contacts and the lower portions of the antennas;

FIG. 23 is a perspective view of the antenna holder shown in FIGS. 20 through 22;

FIG. 24 is a side view of the AM/FM/DAB antenna shown in FIGS. 20 through 22;

FIG. 25 is a perspective view illustrating the AM/FM/DAB antenna shown in FIG. 24 supported by and/or mounted to (e.g., coiled about, etc.) an internal or second antenna carrier or holder of the vehicular antenna assembly according to an exemplary embodiment;

FIG. 26 is a perspective view illustrating the AM/FM/DAB antenna and the antenna carrier shown in FIG. 25, and also illustrating a lower end portion of the AM/FM/DAB antenna extending through an opening (e.g., electrically conductive via or thru-hole, etc.) of and in electrical contact with (e.g., via an SMT mounted contact clip, etc.) the PCB shown in FIGS. 21 and 22;

FIG. 27 is a perspective view illustrating an upper end portion of the AM/FM/DAB antenna shown in FIGS. 24 through 26 extending through an opening in the antenna carrier, where the upper end portion of the AM/FM/DAB antenna is disposed along and in electrical contact with an inner surface portion of an electrically-conductive canopy or capacitive loading element of the vehicular antenna assembly according to an exemplary embodiment; and FIG. 28 is a perspective view illustrating the secondary cellular antenna held within or by a holder or structure of the antenna carrier shown in FIGS. 20 and 22, and also illustrating the lower portion of the secondary cellular antenna electrically connected to the PCB via a contact (e.g., SMT mounted spring contact clip, etc.) along the bottom side of the PCB.

Corresponding reference numerals indicate corresponding parts throughout the several views of the drawings.

DETAILED DESCRIPTION

Example embodiments will now be described more fully with reference to the accompanying drawings FIGS. 2-17 illustrate portions or sub-assemblies of an exemplary embodiment of a vehicular antenna assembly 100 embodying one or more aspects of the present disclosure. As shown in FIGS. 2 and 3, the vehicular antenna assembly 100 includes a first antenna 104, a second antenna 108, and a third antenna 112 coupled to and/or supported by a dielectric (e.g., plastic, etc.) antenna carrier 116 (broadly, a dielectric support).

In this illustrated embodiment, the first and second antennas 104 and 108 are configured to be operable as primary and secondary cellular antennas, respectively. The first or primary cellular antenna 104 may be configured (e.g., inverted L antenna (ILA), planar inverted F antenna (PIFA), etc.) to be operable for both receiving and transmitting communication signals within one or more cellular frequency bands (e.g., Long Term Evolution (LTE), LTE1, LTE2, etc.). The second or secondary cellular antenna 108 may be configured (e.g., a stamped metal wide band monopole antenna mast, etc.) to be operable for receiving (but not transmitting) communication signals within one or more cellular frequency bands (e.g., LTE1, LTE2, etc.). The third antenna 112 is configured to be operable as an AM/FM/DAB antenna (e.g., configured for receiving desired AM/FM/DAB radio signals, etc.). Accordingly, the first, second, and third antennas 104, 108, 112 are also respectively referred to herein as a first or primary cellular antenna 104, a second or secondary cellular antenna 108, and a AM/FM/DAB antenna 112. The vehicular antenna assembly 100 may thus be operable as a multiband multiple input multiple output (MIMO) vehicular antenna assembly.

In FIG. 9, the AM/FM/DAB antenna 112 is shown as a coil or helical radiator (broadly, an electrical conductor) having coils 124 between first and second (or upper and lower) end portions 128, 132, which are generally linear or relatively straight. The AM/FM/DAB antenna 112 may comprise an electrical conductor (e.g., pre-coiled metal or electrically-conductive wire, other pre-coiled electrical conductor, etc.) that is pre-coiled or otherwise configured to have the coils 124 prior to installation of the AM/FM/DAB antenna 112 to the vehicular antenna assembly 100.

In this example, the AM/FM/DAB antenna 112 includes a pre-coiled wire having six coils 124, although other exemplary embodiments may include an AM/FM/DAB antenna 112 having more or less than six coils depending on the particular electrical conductor and relative sizing selected for the AM/FM/DAB antenna 112. By way of example only, the AM/FM/DAB antenna 112 may be created via an automated process in which a winding machine may draw wire or other electrically-conductive material tightly about a rod or other cylindrical member to thereby wind the wire about the rod to create the coils 124. The coiled wire may then be cut and removed from the rod.

As shown in FIG. 18, the AM/FM/DAB antenna 112 may be supported by and/or mounted to an upwardly extending dielectric support or portion 136 of the antenna carrier 116. The antenna carrier portion 136 may be configured as a hollow cylinder or cylindrical member such that the coils 124 of the AM/FM/DAB antenna 112 may be disposed or coiled about the outer circumference or perimeter of the portion 136 of the antenna carrier 116. The coils 124 and the antenna carrier portion 136 may be configured such that an interference or snap fit connection is created between the coils 124 and the antenna carrier portion 136. The pre-coiled wire of the AM/FM/DAB antenna 112 may be manually placed on the antenna carrier portion 136. Alternatively, the pre-coiled wire may be placed on the antenna carrier portion 136 via an automated process.

The AM/FM/DAB antenna 112 may also include a bent or angled portion 138 (FIG. 9) at the top of the AM/FM/DAB antenna 112. The bent portion 138 may be configured to be located within a groove or slot 142 (FIGS. 8 and 10) along the top of the antenna carrier portion 136. Positioning of the bent portion 138 within the slot 142 may inhibit downward sliding of the AM/FM/DAB antenna 112 along the antenna carrier portion 136 and help with alignment of the AM/FM/DAB antenna 112 relative to other features (e.g., PCB 118, canopy 146, etc.) of the vehicular antenna assembly 100.

The AM/FM/DAB antenna 112 may be retained in place along the antenna carrier 136 solely by an interference fit, friction fit, or snap fit connection without requiring soldering, mechanical fasteners, etc. The antenna carrier 116 and the antenna carrier portion 136 may also be referred to herein as first and second antenna carriers 116 and 136.

As shown in FIG. 11, the second or lower end portion 132 of the AM/FM/DAB antenna 112 may be configured to extend through an opening (e.g., electrically conductive via or thru-hole, etc.) in the PCB 118 and into the spring contact clip 140 (broadly, a contact). The contact clip 140 may be mounted via surface-mount technology (SMT) along a bottom of the PCB 118 such that the contact clip's opening is aligned with the opening in the PCB 118. Although FIG. 11 illustrates two PCBs 118 separated by a gap, other exemplary embodiments may include a single PCB or more than two PCBs.

In an exemplary assembly process, the pre-coiled wire of the AM/FM/DAB antenna 112 may be mounted on the antenna carrier 116 as shown in FIG. 10. The antenna carrier 116 and the AM/FM/DAB antenna 112 mounted thereon may be collectively moved as a single unit during assembly to the PCB 118 and chassis or base 144. With this relative movement, the second end portion 132 of the AM/FM/DAB antenna 112 slides through the aligned openings of the PCB 118 and contact clip 140 and into electrical contact with corresponding electrically-conductive portions (e.g., spring fingers, resilient portions, etc.) of the contact clip 140.

As disclosed herein and shown in FIGS. 4, 5, and 6, the antenna carrier 116 may be latched or snap fit onto the base or chassis 144 by engaging latching, snap-tab, or snap clip members 148 of the antenna carrier 116 with corresponding latching, snap-tab, or snap clip members 152 of the base or chassis 144. For example, the antenna carrier 116 may include latches or snap-tabs 148 engageable with corresponding latching surfaces or snap-tab receiving portions 152 of the base 144. The antenna carrier 116 may be moved relatively downwards towards the chassis or base 144 to couple (e.g., snap fit, latch, etc.) the antenna carrier 116 to the base or chassis 144. As described herein, this relative downward movement causes the second end portion 132 of the AM/FM/DAB antenna 112 to slide through the aligned openings of the PCB 118 and contact clip 140 and into electrical contact with corresponding electrically-conductive portions (e.g., resilient wing or finger portions, etc.) of the contact clip 140. The contact 140 may be SMT mounted along a bottom of the PCB 118 prior to assembling the PCB 118 and the antenna carrier 116 to the base or chassis 144. Advantageously, the contact clip 140 may be configured to provide a sufficient electrical connection between the PCB 118 and the AM/FM/DAB antenna 112 such that soldering is not required for the electrical connection between the AM/FM/DAB antenna 112 and the PCB 118.

As shown in FIG. 10, the bent end portion 138 of the AM/FM/DAB antenna 112 may be configured to be disposed along or within the groove or slot 142 along an upper portion of the antenna carrier 116. As shown in FIG. 12B, the bent end portion 138 electrical contacts with an inner surface portion of an electrically-conductive (e.g., sheet metal, etc.) canopy or structure 146. The groove 142 of the antenna carrier 116 may also help with alignment of the AM/FM/DAB antenna 112 relative to other features (e.g., PCB 118, canopy 146, etc.) of the vehicular antenna assembly 100.

As shown in FIG. 12B, the canopy 146 may include a first downwardly extending portion 147 (e.g., a first bent tab, etc.) that electrically contacts the end portion 138 of the AM/FM/DAB 112. The canopy 146 may also include a second downwardly extending portion 149 (e.g., a second bent tab, etc.) that is positionable within a groove or slot along an upper portion of the antenna carrier 112 as shown in FIG. 12C. An upwardly extending portion 151 (e.g., post, alignment pin, etc.) of the antenna carrier 116 may be configured to extend through an opening in the canopy 146 as shown in FIG. 12A.

The electrical contact between the end portion 138 of the AM/FM/DAB antenna 112 and the canopy 146 may be created and secured by the assembly of the radome 190 (FIGS. 18 and 19A) onto the base or chassis 144. As the radome 190 is assembled onto the base or chassis 144, the electrically-conductive canopy or structure 146 underneath the radome 190 may contact the end portion 138 of the AM/FM/DAB antenna 112. The radome 190 may be coupled to the base or chassis 144, whereby the end portion 138 of the AM/FM/DAB antenna 112 is then retained between and in contact with the inner surface portion of the electrically-conductive canopy or structure 146 and an outer surface portion of the antenna carrier 116.

Electrically connecting the AM/FM/DAB antenna 112 to the electrically-conductive canopy or structure 146 helps define a capacitively loaded portion of the AM/FM/DAB antenna 112. The electrically-conductive canopy or structure 146 may also be referred to herein as a top load element or plate. During use, the electrically-conductive canopy or structure 146 operates to form a capacitive load portion of the AM/FM/DAB antenna 112.

The AM/FM/DAB antenna 112 may be operable at one or more frequencies including, for example, frequencies ranging between about 140 KHz and about 110 MHz, etc. For example, the illustrated AM/FM/DAB antenna 112 can be resonant in the FM band (e.g., at frequencies between about 88 MHz and about 108 MHz, etc.) and can also work at AM frequencies, but may not at all be resonant at various AM frequencies (e.g., frequencies between about 535 KHz and about 1735 KHz, etc.). The AM/FM/DAB antenna 112 may also be tuned, as desired, for operation at desired frequency bands by, for example, adjusting size and/or number and/or orientation and/or type of the coils 124, etc. For example, the AM/FM/DAB antenna 112 could be tuned (or retuned), as desired, to Japanese FM frequencies (e.g., including frequencies between about 76 MHz and about 93 MHz, etc.), DAB-VHF-III (e.g., including frequencies between about 174 MHz and about 240 MHz, etc.) other similar VHF bands, other frequency bands, etc.

As shown in FIGS. 7 and 11, contact between the antennas 104, 108, 112 and the PCB 118 may be achieved by introducing spring contact clips 156, 160, 140 (broadly, contacts) mounted via surface-mount technology (SMT) along the PCB 118. Contact clip 140 may be used for achieving contact between the AM/FM/DAB antenna 112 and the PCB 118 without having to solder the antenna 112 to the PCB 118. Contact clips 156 may be used for achieving contact between the first or primary cellular antenna 104 and the PCB 118 without having to solder the antenna 104 to the PCB 118. Contact clip 160 may be used for achieving contact between the second or secondary cellular antenna 108 and the PCB 118 without having to solder the antenna 108 to the PCB 118. The antenna carrier 116, including the antennas 104, 108, 112 carried thereby, may be collectively moved as a single unit during assembly to the PCB 118 and chassis or base 144. With the relative downward movement of the antenna carrier 116 towards the PCB 118, the end portions 164, 168, 132 of the respective antennas 104, 108, 112 slide through aligned openings of the PCB 118 and the respective contact clips 156, 160, and 140 and into electrical contact with corresponding electrically-conductive portions (e.g., resilient wing or finger portions, etc.) of the contact clips 156, 160, 140. Advantageously, the contact clips 156, 160, and 140 may be configured to provide a sufficient electrical connection between the PCB 118 and the antennas 104, 108, 112, respectively, such that soldering is not required for the electrical connections between the antennas 104, 108, 112 and the PCB 118.

Dielectric (e.g., plastic, etc.) structure of the antenna carrier 116 may be used to provide mechanical strength. For example, the antenna carrier 116 may comprise dielectric structure (e.g., wall portions, latches, snap clip members, etc.) for clamping onto or creating an interference or snap fit connection between the first and second cellular antennas 104, 108 and the dielectric structure. The first and second cellular antennas 104, 108 may be retained in place solely by the interference or snap fit connection without requiring soldering, mechanical fasteners, etc.

As shown in FIGS. 2, 3, and 8, the dielectric antenna carrier 116 includes latches or snap clip members 172 and supports 176 for respectively contacting upward and downward facing surfaces of the first cellular antenna 104 for inhibiting upward and downward movement of the first cellular antenna 104 relative to the antenna carrier 116. The latches or snap clip members 172 and supports 176 may cooperative to create an interference or snap fit connection with the first cellular antenna 104 such that the first cellular antenna 104 is retained in place solely by the interference or snap fit connection without requiring soldering, mechanical fasteners, etc.

As shown in FIGS. 8 and 13, the dielectric antenna carrier 116 includes a latch or snap clip member 180 and supports 184 for respectively contacting surfaces of the second cellular antenna 108 for inhibiting movement of the second cellular antenna 108 relative to the antenna carrier 116. The latch or snap clip member 180 and supports 184 may cooperative to create an interference or snap fit connection with the second cellular antenna 108, such that the second cellular antenna 108 is retained in place solely by the interference or snap fit connection without requiring soldering, mechanical fasteners, etc.

With reference to FIGS. 4 and 8, the antenna carrier 116 includes snap-tabs 148 for engagement with corresponding beveled snap-tab receiving portions 152 associated with the base or chassis 144 to help secure (e.g., via a snap fit assembly or connection, etc.) the antenna carrier 116 to the base 144. The snap-tab receiving portions 152 are designed to engage the flexible snap-tabs 148 of the antenna carrier 116 to fasten and matingly secure the antenna carrier 116 to the base 144. The antenna carrier 116 also includes tabs 153 having openings for engaging latches 151 of the base 144 as shown in FIGS. 5 and 6. Essentially, as the antenna carrier 116 is positioned downwardly onto the base 144, the snap-tabs 148 of the antenna carrier 116 may momentarily flex outwardly and then return back inwardly in the reverse direction after they have cleared the snap-tab receiving portions 152 of the base 144. Also, as the antenna carrier 116 is positioned downwardly onto the base 144, the latches 155 of the base 144 may momentarily flex inwardly and then return back outwardly in the reverse direction after they have cleared the openings in the tabs 153 of the antenna carrier 116.

In the illustrated embodiment, the antenna carrier 116 includes two snap-tabs 148 spaced apart along a first longitudinal side of the antenna carrier 116 and two tabs 153 spaced apart along an opposite second longitudinal side of the antenna carrier 116. The base 144 includes two corresponding snap-tab receiving portions 152 spaced apart along a first longitudinal sides of the base 144 and two corresponding latches 155 spaced apart along an opposite second longitudinal sides of the base 144. Alternatively, more or less snap-tabs 148, snap-tab receiving portions 152, tabs 153, and latches 155 and/or different arrangements of the same may be used in other embodiments. For example, the antenna carrier 116 may also or alternatively have snap-tabs 148 located at or adjacent the front and back longitudinal ends of the antenna carrier 116. In addition, the arrangement of the snap-tabs 148 and snap-tab receiving portions 152 may be reversed. In which case, the base 144 may include snap-tabs with the antenna carrier 116 including the snap-tab receiving portions. Alternatively or additionally, mechanical fasteners, such as screws, among other fastening devices, etc., may also be used for securing the antenna carrier 116 to the base 144 in other exemplary embodiments. Alternative embodiments may include other means for attaching an antenna carrier to a chassis or base, such as by ultrasonic welding, interference or snap fit, solvent welding, heat staking, latching, bayonet connections, hook connections, integrated fastening features, mechanical fasteners, combinations thereof, etc.

In addition to the primary and secondary cellular antennas 104, 108 and the AM/FM/DAB antenna 112, the vehicular antenna assembly 100 may also include one or more other antennas operable at one or more different frequencies or bandwidths, such as Satellite Digital Audio Radio Service (SDARS) (e.g., SiriusXM satellite radio, etc.), Wi-Fi, Global Navigation Satellite System (GNSS) (e.g., Global Positioning System (GPS), BeiDou Navigation Satellite System (BDS), the Russian Global Navigation Satellite System (GLONASS), other satellite navigation system frequencies, etc.), etc.

In the exemplary embodiment shown in FIG. 17, the vehicular antenna assembly 100 includes a first patch antenna 186 and a second patch antenna 188. The first patch antenna 186 may be configured to be operable for receiving SDARS signals. The second patch antenna 188 may be configured to be operable for receiving GNSS signals or frequencies. In this example, the first and second patch antennas 186, 188 are horizontally spaced apart from each other along the front PCB 118 located towards the front or forward end portion of the antenna assembly 100. Alternative embodiments may include patch antennas in a stacked arrangement with one of the patch antennas stacked on top of the other patch antenna.

The antennas 104, 108, 112, the antenna carrier 116, the PCB 118, and the first and second patch antennas 186, 188 may be disposed within an interior collectively defined by or between the base 144 and a radome 190 (FIGS. 18 and 19). The radome 190 may have a shark fin shape, such that the antenna assembly 100 may also be referred to as a shark fin antenna assembly.

As shown in FIG. 18, a reflector 192 is internally mounted under or within the radome 190. The radome 190 is positionable over the antenna components shown in FIG. 17 such that the reflector 192 is positioned above the patch antenna 186 (e.g., SDARS patch antenna, etc.) for reflecting antenna signals generally towards the patch antenna 186. The reflector 192 may be configured to operable for helping increase passive antenna gain at higher elevation angles. But in doing so, the reflector may also decrease passive antenna gain at lower elevation as the total energy radiated is the same, it is just being distributed differently in space.

FIGS. 19A, 19B, and 19C illustrate an exemplary manner that the radome 190 may be coupled with (e.g., snap clipped, snap fit, latched onto, etc.) the chassis or base 144. The radome 190 may be latched or snap fit onto the base or chassis 144 by engaging latching, snap-tab, or snap clip members of the radome 190 with corresponding latching, snap-tab, or snap clip members of the base or chassis 144. For example, the base 144 may include front and back latches or snap-tabs 194 engageable with corresponding front and back latching surfaces or snap-tab receiving portions 195 of the radome 190 as shown in FIGS. 19A and 19B. Also, for example, the radome 190 may include latches or snap-tabs 196 along the left and right longitudinal sides of the radome 190 that are engageable with corresponding latching surfaces or snap-tab receiving portions 197 along the left and right longitudinal sides of the base 144 as shown in FIGS. 19A and 19C. Alternative embodiments may include a radome coupled to a base or chassis in a different way, such by mechanical fasteners, ultrasonic welding, interference or snap fit, solvent welding, heat staking, latching, bayonet connections, hook connections, integrated fastening features, combinations thereof, etc.

FIGS. 20-28 illustrate portions or sub-assemblies of an exemplary embodiment of a vehicular antenna assembly 200 embodying one or more aspects of the present disclosure. As shown in FIGS. 20 and 21, the vehicular antenna assembly 200 includes a first antenna 204, a second antenna 208, and a third antenna 212 coupled to and/or supported by a dielectric (e.g., plastic, etc.) antenna carrier 216 (broadly, a dielectric support).

In this illustrated embodiment, the first and second antennas 204 and 208 are configured to be operable as primary and secondary cellular antennas, respectively. The first or primary cellular antenna 204 may be configured (e.g., inverted L antenna (ILA), planar inverted F antenna (PIFA), etc.) to be operable for both receiving and transmitting communication signals within one or more cellular frequency bands (e.g., Long Term Evolution (LTE), LTE1, LTE2, etc.). The second or secondary cellular antenna 208 may be configured (e.g., a stamped metal wide band monopole antenna mast, etc.) to be operable for receiving (but not transmitting) communication signals within one or more cellular frequency bands (e.g., LTE1, LTE2, etc.). The third antenna 212 is configured to be operable as an AM/FM/DAB antenna (e.g., configured for receiving desired AM/FM/DAB radio signals, etc.). Accordingly, the first, second, and third antennas 204, 208, 212 are also respectively referred to herein as a first or primary cellular antenna 204, a second or secondary cellular antenna 208, and a AM/FM/DAB antenna 212. The vehicular antenna assembly 200 may thus be operable as a multiband multiple input multiple output (MIMO) vehicular antenna assembly.

In FIGS. 24 through 27, the AM/FM/DAB antenna 212 is shown as a coil or helical radiator (broadly, an electrical conductor) having coils 224 between first and second (or upper and lower) end portions 228, 232, which are generally linear or relatively straight. The AM/FM/DAB antenna 212 may comprise an electrical conductor (e.g., pre-coiled metal or electrically-conductive wire, other pre-coiled electrical conductor, etc.) that is pre-coiled or otherwise configured to have the coils 224 prior to installation of the AM/FM/DAB antenna 212 to the vehicular antenna assembly 200.

In this example, the AM/FM/DAB antenna 212 includes a pre-coiled wire having five coils 224, although other exemplary embodiments may include an AM/FM/DAB antenna 212 having more or less than five coils depending on the particular electrical conductor and relative sizing selected for the AM/FM/DAB antenna 212. By way of example only, the AM/FM/DAB antenna 212 may be created via an automated process in which a winding machine may draw wire or other electrically-conductive material tightly about a rod or other cylindrical member to thereby wind the wire about the rod to create the coils 224. The pre-coiled wire may then be cut and removed from the rod.

As shown in FIG. 25, the AM/FM/DAB antenna 212 may be supported by and/or mounted to a dielectric (e.g., plastic, etc.) antenna carrier or holder 236 (broadly, a dielectric support or portion). The antenna carrier 236 may be configured as a hollow circular cylinder or cylindrical member such that the coils 224 of the AM/FM/DAB antenna 212 may be disposed or coiled about the outer circumference or perimeter of the antenna carrier 236. The coils 224 and the antenna carrier 236 may be configured such that an interference or snap fit connection is created between the coils 224 and the antenna carrier 236. The pre-coiled wire of the AM/FM/DAB antenna 212 may be manually placed on the antenna carrier 236. Alternatively, the pre-coiled wire may be placed on the antenna carrier 236 via an automated process.

The AM/FM/DAB antenna 212 may also include a bent or angled portion 238 (FIGS. 24 and 25) between the lowermost coil 224 and the lower end portion 232. The bent portion 238 may be configured to be located within an open-ended upwardly extending groove or slot 242 (FIG. 25) along the bottom of the antenna carrier 236. Positioning of the bent portion 238 within the slot 242 may inhibit upward sliding of the AM/FM/DAB antenna 212 along the antenna carrier 236 and help with alignment of the AM/FM/DAB antenna 212 relative to other features (e.g., PCB 218, etc.) of the vehicular antenna assembly 200.

The AM/FM/DAB antenna 212 may be retained in place along the antenna carrier 236 solely by an interference fit, friction fit, or snap fit connection without requiring soldering, mechanical fasteners, etc. The antenna carrier 236 may be disposed within a hollow interior defined by the antenna carrier 216. Accordingly, the antenna carrier 216 and 236 may also respectively be referred to herein as the first and second (or inner and outer) antenna carriers 216 and 236.

As shown in FIG. 26, the second or lower end portion 232 of the AM/FM/DAB antenna 212 may be configured to extend through an opening (e.g., electrically conductive via or thru-hole, etc.) in the PCB 218 and into the contact 240 (e.g., a spring contact clip, etc.). The contact 240 may be mounted via surface-mount technology (SMT) along a bottom of the PCB 218 such that the contact clip's opening is aligned with the opening in the PCB 218. In an exemplary assembly process, the pre-coiled wire of the AM/FM/DAB antenna 212 may be mounted on the second antenna carrier 236 as shown in FIG. 25. The first antenna carrier 216, including the AM/FM/DAB antenna 212 mounted on the second antenna carrier 236, may be collectively moved as a single unit during assembly to the PCB 218 and chassis or base 244. With this relative movement, the second end portion 232 of the AM/FM/DAB antenna 212 slides through the aligned openings of the PCB 218 and contact clip 240 and into electrical contact with corresponding electrically-conductive portions (e.g., spring finger or resilient wing portions, etc.) of the contact clip 240.

As disclosed herein and shown in FIG. 21, the first antenna carrier 216 may be latched or snap fit onto the base or chassis 244 by engaging latching, snap-tab, or snap clip members 248 of the first antenna carrier 216 with corresponding latching, snap-tab, or snap clip members 252 of the base or chassis 244. For example, the first antenna carrier 216 may include latches or snap-tabs 248 engageable with corresponding latching surfaces or snap-tab receiving portions 252 of the base 244. The first antenna carrier 216 may be moved relatively downwards towards the chassis or base 244 to couple (e.g., snap fit, latch, etc.) the first antenna carrier 216 to the base or chassis 244. As described herein, this relative downward movement causes the second end portion 232 of the AM/FM/DAB antenna 212 to slide through the aligned openings of the PCB 218 and contact clip 240 and into electrical contact with corresponding electrically-conductive portions (e.g., spring finger or resilient wing portions, etc.) of the contact clip 240. The contact clip 240 may be SMT mounted along a bottom of the PCB 218 prior to assembling the PCB 218 and the first antenna carrier 216 to the base or chassis 244. Advantageously, the contact clip 240 may be configured to provide a sufficient electrical connection between the PCB 218 and the AM/FM/DAB antenna 212 such that soldering is not required for the electrical connection between the AM/FM/DAB antenna 212 and the PCB 218.

As shown in FIGS. 25 and 26, the first or upper end portion 228 of the AM/FM/DAB antenna 212 may be configured to extend through an opening 250 (FIG. 23) in the top or upper portion of the antenna carrier 216. As shown in FIG. 27, the first end portion 228 of the AM/FM/DAB antenna 212 is flexed, bent, deformed, or otherwise configured so as to be disposed along or within a groove or slot 254 (FIG. 23) along an outer surface of the first antenna carrier 216 and along and in electrical contact with an inner surface portion of an electrically-conductive (e.g., sheet metal, etc.) canopy or structure 246. The opening 250 and groove 254 of the antenna carrier 216 may also help with alignment of the AM/FM/DAB antenna 212 relative to other features (e.g., PCB 218, etc.) of the vehicular antenna assembly 200.

The electrically-conductive canopy or structure 246 may be coupled to and disposed within an interior of a radome, such as a radome having a shark fin shape, etc. The electrical contact between the first end portion 228 of the AM/FM/DAB antenna 212 and the canopy 246 may be created and secured by the assembly of the radome onto the base or chassis 244. As the radome is assembled onto the base or chassis 244, the electrically-conductive canopy or structure 246 underneath the radome may contact and thus cause the first end portion 228 of the AM/FM/DAB antenna 212 to be flexed, bent, deformed, or otherwise configured as shown by comparing the first end portion 228 as shown in FIG. 25 with the first end portion 228 shown in FIG. 27. After this reconfiguration (e.g., deformation, flexing, bending, etc.), the first end portion 228 of the AM/FM/DAB antenna 212 is disposed along and in electrical contact with the inner surface portion of the electrically-conductive canopy or structure 246. The radome may then be coupled to the base or chassis 244, whereby the first end portion 228 of the AM/FM/DAB antenna 212 is then retained between and in contact with the inner surface portion of the electrically-conductive canopy or structure 246 and an outer surface portion of the first antenna carrier 216. The radome may be coupled to the base or chassis 244 by mechanical fasteners, ultrasonic welding, interference or snap fit, solvent welding, heat staking, latching, bayonet connections, hook connections, integrated fastening features, combinations thereof, etc.

Electrically connecting the AM/FM/DAB antenna 212 to the electrically-conductive canopy or structure 246 helps define a capacitively loaded portion of the AM/FM/DAB antenna 212. The electrically-conductive canopy or structure 246 may also be referred to herein as a top load element or plate. During use, the electrically-conductive canopy or structure 246 operates to form a capacitive load portion of the AM/FM/DAB antenna 212.

The AM/FM/DAB antenna 212 may be operable at one or more frequencies including, for example, frequencies ranging between about 140 KHz and about 110 MHz, etc. For example, the illustrated AM/FM/DAB antenna 212 can be resonant in the FM band (e.g., at frequencies between about 88 MHz and about 108 MHz, etc.) and can also work at AM frequencies, but may not at all be resonant at various AM frequencies (e.g., frequencies between about 535 KHz and about 1735 KHz, etc.). The AM/FM/DAB antenna 212 may also be tuned, as desired, for operation at desired frequency bands by, for example, adjusting size and/or number and/or orientation and/or type of the coils 224, etc. For example, the AM/FM/DAB antenna 212 could be tuned (or retuned), as desired, to Japanese FM frequencies (e.g., including frequencies between about 76 MHz and about 93 MHz, etc.), DAB-VHF-III (e.g., including frequencies between about 174 MHz and about 240 MHz, etc.) other similar VHF bands, other frequency bands, etc.

As shown in FIG. 22, contact between the antennas 204, 208, 212 and the PCB 218 may be achieved by introducing spring contact clips 256, 260, 240 (broadly, contacts) mounted via surface-mount technology (SMT) along the PCB 218. Contact clip 240 may be used for achieving contact between the AM/FM/DAB antenna 212 and the PCB 218 without having to solder the antenna 212 to the PCB 218. Contact clip 256 may be used for achieving contact between the first or primary cellular antenna 204 and the PCB 218 without having to solder the antenna 204 to the PCB 218. Contact clip 260 may be used for achieving contact between the second or secondary cellular antenna 208 and the PCB 218 without having to solder the antenna 208 to the PCB 218. The first antenna carrier 216, including the antennas 204, 208, 212 carried thereby, may be collectively moved as a single unit during assembly to the PCB 218 and chassis or base 244. With the relative downward movement of the first antenna carrier 216 towards the PCB 218, the end portions 264, 268, 232 of the respective antennas 204, 208, 212 slide through aligned openings of the PCB 218 and the respective contact clips 256, 260, and 240 and into electrical contact with corresponding electrically-conductive portions (e.g., spring finger or resilient wing portions, etc.) of the contact clips 256, 260, 240. Advantageously, the contact clips 256, 260, and 240 may be configured to provide a sufficient electrical connection between the PCB 218 and the antennas 204, 208, 212, respectively, such that soldering is not required for the electrical connections between the antennas 204, 208, 212 and the PCB 218.

Dielectric (e.g., plastic, etc.) structure of the antenna carrier 216 may be used to provide mechanical strength. For example, the antenna carrier 216 may comprise dielectric structure (e.g., wall portions, latches, snap clip members, etc.) for clamping onto or creating an interference or snap fit connection between the first and second cellular antennas 204, 208 and the dielectric structure. The first and second cellular antennas 204, 208 may be retained in place solely by the interference or snap fit connection without requiring soldering, mechanical fasteners, etc.

As shown in FIGS. 20, 21, and 23, the dielectric antenna carrier 216 includes latches or snap clip members 272 and supports 276 for respectively contacting upward and downward facing surfaces of the first cellular antenna 204 for inhibiting upward and downward movement of the first cellular antenna 204 relative to the antenna carrier 216. The supports 276 define recessed portions for engagingly receiving a portion of the first cellular antenna 204 for inhibiting forward and backward movement of the first cellular antenna 204 relative to the antenna carrier 216. The latches or snap clip members 272 and supports 276 may cooperative to create an interference or snap fit connection with the first cellular antenna 204 such that the first cellular antenna 204 is retained in place solely by the interference or snap fit connection without requiring soldering, mechanical fasteners, etc.

As shown in FIGS. 23 and 28, the dielectric antenna carrier 216 includes a latch or snap clip member 280 and supports 284 for respectively contacting upward and downward facing surfaces of the second cellular antenna 208 for inhibiting upward and downward movement of the second cellular antenna 208 relative to the antenna carrier 216. The supports 284 define recessed portions for engagingly receiving a portion of the second cellular antenna 208 for inhibiting forward and backward movement of the second cellular antenna 208 relative to the antenna carrier 216. The latch or snap clip member 280 and supports 284 may cooperative to create an interference or snap fit connection with the second cellular antenna 208, such that the second cellular antenna 208 is retained in place solely by the interference or snap fit connection without requiring soldering, mechanical fasteners, etc.

With reference to FIGS. 21 and 23, the antenna carrier 216 includes snap-tabs 248 for engagement with corresponding beveled snap-tab receiving portions 252 associated with the base or chassis 244 to help secure (e.g., via a snap fit assembly or connection, etc.) the antenna carrier 216 to the base 244. The snap-tab receiving portions 252 are integrally located along a perimeter of the base 244. The snap-tab receiving portions 252 are designed to engage the flexible snap-tabs 248 of the antenna carrier 216 to fasten and matingly secure the antenna carrier 216 to the base 244. Essentially, as the antenna carrier 216 is positioned downwardly onto the base 244, the snap-tabs 248 momentarily flex outwardly and then return back inwardly in the reverse direction after they have cleared the snap-tab receiving portions 252. In the illustrated embodiment, the antenna carrier 216 includes a pair of snap-tabs 248 on each longitudinal side of the antenna carrier 216. The base 244 includes two corresponding snap-tab receiving portions 252 on each of the two longitudinal sides of the base 244. Alternatively, more or less snap-tabs 248 and receiving portions 252 and/or different arrangements of the same may be used in other embodiments. For example, the antenna carrier 216 may also or alternatively have snap-tabs 248 located at or adjacent the front and back longitudinal ends of the antenna carrier 216. In addition, the arrangement of the snap-tabs 248 and snap-tab receiving portions 252 may be reversed. In which case, the base 244 may include snap-tabs with the antenna carrier 216 including the snap-tab receiving portions. Alternatively or additionally, mechanical fasteners, such as screws, among other fastening devices, etc., may also be used for securing the antenna carrier 216 to the base 244 in other exemplary embodiments. Alternative embodiments may include other means for attaching an antenna carrier to a chassis or base, such as by ultrasonic welding, interference or snap fit, solvent welding, heat staking, latching, bayonet connections, hook connections, integrated fastening features, mechanical fasteners, combinations thereof, etc.

The antennas 204, 208, 212, the antenna carrier 216, and the PCB 218 may be disposed within an interior collectively defined by or between the base 244 and a radome. The radome may have a shark fin shape, such that the antenna assembly 200 may also be referred to as a shark fin antenna assembly.

In addition to the primary and secondary cellular antennas 204, 208 and the AM/FM/DAB antenna 212, the vehicular antenna assembly 200 may also include one or more other antennas operable at one or more different frequencies or bandwidths, such as Satellite Digital Audio Radio Service (SDARS) (e.g., SiriusXM satellite radio, etc.), Wi-Fi, Global Navigation Satellite System (GNSS) (e.g., Global Positioning System (GPS), BeiDou Navigation Satellite System (BDS), the Russian Global Navigation Satellite System (GLONASS), other satellite navigation system frequencies, etc.), etc. For example, the vehicular antenna assembly 200 may further include a first patch antenna configured to be operable for receiving SDARS signals and a second patch antenna configured to be operable for receiving GNSS signals or frequencies. The first and second patch antennas may be horizontally spaced apart from each other or in a stacked arrangement with one of the patch antennas stacked on top of the other patch antenna.

In exemplary embodiments, a vehicular antenna assembly may be installed or mounted on a vehicle surface, such as the roof, trunk, or hood to help ensure that the antennas have unobstructed views overhead or toward the zenith and such that the mounting surface of the automobile acts as a ground plane for the antenna assembly and improves reception of signals. For example, the vehicular antenna assembly may be configured to be installed and fixedly mounted to a body wall of a vehicle after being inserted into a mounting hole in the body wall from an external side of the vehicle and nipped from an interior compartment side of the vehicle. The antennas may be connected (e.g., via a coaxial cable, etc.) to one or more electronic devices (e.g., a radio receiver, a touchscreen display, navigation device, cellular phone, etc.) inside the passenger compartment of the vehicle, such that the vehicular antenna assembly is operable for transmitting and/or receiving signals to/from the electronic device(s) inside the vehicle.

In at least some exemplary embodiments, an intermediate dielectric (e.g., plastic, etc.) carrier is provided that assures mechanical fixation of the antenna elements and replaces the conventional soldering joints. Primary and secondary cellular antennas and an AM/FM/DAB antenna may be assembled to and then carried by the dielectric carrier by means of snap-fit connections. The assembly (carrier and antenna elements) may then be mounted to a base or chassis using other snap-fit connections. After being assembled, contact between the antenna elements and the PCB may be secured using contact clips SMT mounted along a bottom of the PCB. A dielectric radome may be positioned generally over intermediate dielectric carrier and antenna carried thereby. The radome may be coupled to a base or chassis such that an interior enclosure is defined by the radome and the chassis. The intermediate dielectric carrier, antennas carried thereby, and the PCB may be disposed within the interior enclosure.

In at least some exemplary embodiments, contact between various antenna elements and the PCB may be achieved by introducing spring contact clips SMT mounted along the PCB. A dielectric (e.g., plastic, etc.) structure may be used to provide mechanical strength. For example, a dielectric antenna holder may comprise latches, snap clip members, wall portions, or other structures for clamping onto or creating an interference or snap fit connection with an antenna element. The antenna element may then be retained in place solely by the interference or snap fit connection without requiring soldering, mechanical fasteners, etc.

In at least some exemplary embodiments, a pre-coiled wire is used for the AM/FM/DAB antenna instead of a vertical PCB element. The wire is mounted to a dielectric (e.g., plastic, etc.) holder. When the dielectric holder is assembled to a base or chassis, the wire slides through aligned openings in the PCB and contact clip and makes electrical contact with the contact clip. The AM/FM/DAB antenna's contact with an electrically-conductive canopy or structure is secured by the assembly of the radome to the base or chassis.

Figure 1:
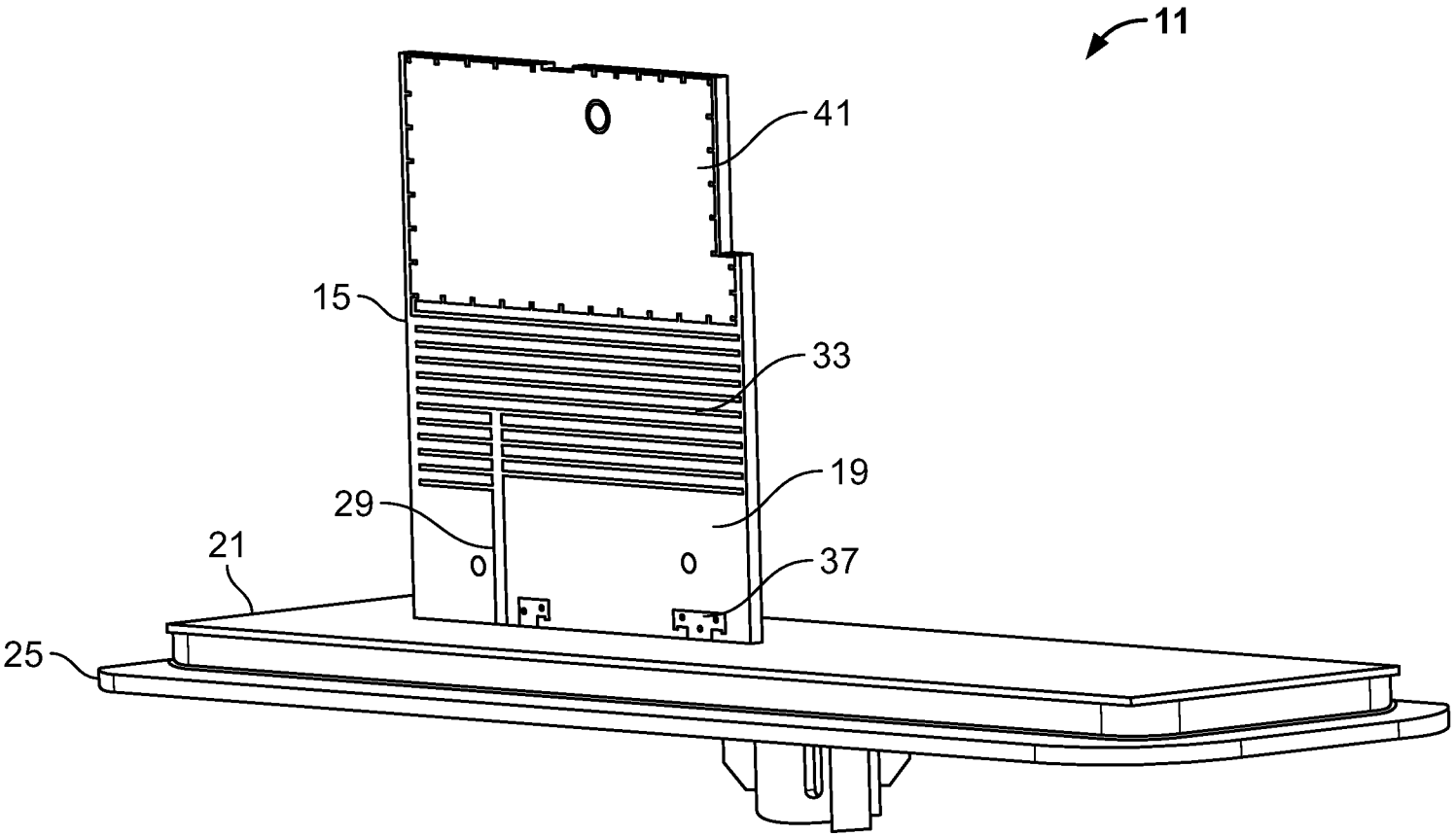
FIG. 1 (Prior Art)
FIG. 1 is a perspective view of a conventional vehicular antenna assembly that includes a PCB antenna with AM/FM/DAB antenna elements.

Accordingly, disclosed herein are exemplary embodiments in which it is not necessary to solder the antenna element connections to the PCB. By eliminating the need to solder the antenna element connections to the PCB, exemplary embodiments disclosed herein may have or provide one or more (but not necessarily any or all) of the following features or advantages over the conventional vehicular antenna assembly 11 shown in FIG. 1. For example, exemplary embodiments disclosed herein may allow for a more simplified assembly process, reduced cycle time, reduced cost of materials, and reduced cost of assembly. Exemplary embodiments disclosed herein may allow for the elimination of the need for soldering. Exemplary embodiments disclosed herein may allow for consistent mechanical structural strength and consistent electrical conductivity.

By comparison, conventional cellular antennas and AM/FM/DAB elements are mechanically fixed and electrically connected to PCBs through manual soldering joints. The soldering provides both a mechanical fixation and electrical contact. Soldering parameters (amount/duration/curing), however, are oftentimes inconsistent, which results in various joint strengths and possible failure under mechanical shock load and vibration. Manual soldering is usually employed because of the high complexity of automated soldering for these types of antenna elements. But manual soldering is considered high cost.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vehicular antenna assembly comprising:

a printed circuit board having an opening;

a contact clip along the printed circuit board, the contact clip having an opening aligned with the opening of the printed circuit board;

a dielectric antenna carrier; and at least one antenna mechanically coupled to the dielectric antenna carrier by an interference or snap fit connection and without any soldering joint between the at least one antenna and the dielectric antenna carrier, the at least one antenna including a lower end portion that extends downwardly relative to the dielectric antenna carrier, whereby the lower end portion is positionable within the aligned openings of the contact clip and the printed circuit board and into electrical contact with the contact along the printed circuit board when the dielectric antenna carrier and the at least one antenna are moved relatively downward toward the printed circuit board, to thereby provide a sufficient electrical connection between the at least one antenna and the printed circuit board without soldering the at least one antenna to the printed circuit board.

2. The vehicular antenna assembly of claim 1, wherein:

the contact is along a lower surface of the printed circuit board such that the opening of the contact is aligned with the opening of the printed circuit board; and the lower end portion of the at least one antenna extends through the aligned openings of the contact and the printed circuit board and electrical contacts the contact clip.

3. The vehicular antenna assembly of claim 2, wherein:

the contact comprises a spring contact clip;

the vehicular antenna assembly includes a chassis; and the dielectric antenna carrier is configured to be coupled with the chassis via a snap-fit connection when the dielectric antenna carrier is moved relatively downwardly towards the chassis, whereby the relative downward movement positions the lower end portion of the at least one antenna through the aligned openings of the spring contact clip and the printed circuit board and into electrical contact with the spring contact clip.

4. The vehicular antenna assembly of claim 1, wherein:

the contact clip includes resilient wing portions or spring fingers; and the lower end portion of the at least one antenna slides through the aligned openings of the contact clip and the printed circuit board into electrical contact with the resilient wing portions or spring fingers of the contact clip when the dielectric antenna carrier and the at least one antenna are moved relatively downward toward the printed circuit board.

5. The vehicular antenna assembly of claim 4, wherein the contact clip is SMT mounted along a lower surface of the printed circuit board.

6. The vehicular antenna assembly of claim 1, wherein:

the at least one antenna comprises a pre-coiled wire including the lower end portion, an upper end portion, and one or more coils between the upper and lower end portions; and the one or more coils of the pre-coiled wire are disposed about an outer perimeter of a portion of the dielectric antenna carrier such that the lower end portion extends downwardly for electrical connection with the printed circuit board.

7. The vehicular antenna assembly of claim 6, wherein:

the portion of the antenna carrier includes a cylindrical member, and the pre-coiled wire and the cylindrical member are configured such that the pre-coiled wire is coupled to the cylindrical member of the dielectric antenna carrier by an interference or snap fit connection between the coils and the cylindrical member without a soldering joint between the pre-coiled wire and the dielectric antenna carrier; and/or the vehicular antenna assembly further includes a radome and an electrically-conductive structure or canopy underneath or within an interior defined by the radome such that the electrically-conductive structure or canopy is in electrical contact with the upper end portion of the pre-coiled wire when the radome is positioned over the dielectric antenna carrier and assembled to a chassis.

8. The vehicular antenna assembly of claim 7, wherein the pre-coiled wire is configured to be operable as an AM/FM/DAB antenna, and wherein:

the upper end portion of the pre-coiled wire includes a bent or angled portion located within a slot along an upper portion of the dielectric antenna carrier that inhibits downward sliding of the pre-coiled wire along the cylindrical member; or the upper end portion of the pre-coiled wire extends through an opening in an upper portion of the dielectric antenna carrier and into electrical contact with the electrically-conductive structure or canopy.

9. The vehicular antenna assembly of claim 1, wherein the dielectric antenna carrier includes:

one or more latches or snap clip members and one or more supports for contacting surfaces of the at least one antenna to thereby inhibit movement of the at least one antenna relative to the dielectric antenna carrier;

whereby the at least one antenna is coupled to the dielectric antenna carrier by the engagement of the at least one antenna and the one or more latches or snap clip members and the one or more supports.

10. The vehicular antenna assembly of claim 1, wherein:

the printed circuit board includes at least one or more printed circuit boards defining a first PCB opening and a second PCB opening;

the contact comprises:

a first contact clip mounted along a lower surface of the printed circuit board, the first contact clip having a first opening aligned with the first PCB opening;

a second contact clip mounted along the lower surface of the printed circuit board, the second contact clip having a second opening aligned with the second PCB opening; and the at least one antenna comprises first and second antennas coupled to the dielectric antenna carrier such that the dielectric antenna carrier and the first and second antennas are collectively movable as a single unit relatively downward toward the printed circuit board to thereby position:

a lower end portion of the first antenna through the aligned first opening of the first contact clip and the first PCB opening and into electrical contact with the first contact clip; and a lower end portion of the second antenna through the aligned second opening of the second contact clip and the second PCB opening and into electrical contact with the second contact clip.

11. The vehicular antenna assembly of claim 10, wherein:

the first and second contact clips comprise spring contact clips that are SMT mounted along the lower surface of the printed circuit board; and the first and second antennas are electrically connected to the printed circuit board without soldering.

12. The vehicular antenna assembly of claim 1, wherein:

the printed circuit board (PCB) includes at least one or more printed circuit boards defining a first PCB opening, a second PCB opening, and a third PCB opening;

the contact comprises:

a first contact clip along a lower surface of the printed circuit board, the first contact clip having a first opening aligned with the first PCB opening;

a second contact clip along the lower surface of the printed circuit board, the second contact clip having a second opening aligned with the second PCB opening; and a third contact clip along the lower surface of the printed circuit board, the third contact clip having a third opening aligned with the third PCB opening;

the at least one antenna comprises:

a first antenna coupled to the dielectric antenna carrier and having a lower end portion that extends through the aligned first opening of the first contact clip and the first PCB opening and that electrically contacts the first contact clip;

a second antenna coupled to the dielectric antenna carrier and having a lower end portion that extends through the aligned second opening of the second contact clip and the second PCB opening and that electrical contacts the second contact clip; and a third antenna coupled to the dielectric antenna carrier and having a lower end portion that extends through the aligned third opening of the third contact clip and the third PCB opening and that electrical contacts the third contact clip.

13. The vehicular antenna assembly of claim 12, wherein:

the first antenna is a primary cellular antenna configured to be operable for both receiving and transmitting communication signals within one or more cellular frequency bands;

the second antenna is a secondary cellular antenna configured to be operable for receiving (but not transmitting) communication signals within one or more cellular frequency bands;

the third antenna is configured to be operable as an AM/FM/DAB antenna, the first, second, and third contact clips comprise spring contact clips that are SMT mounted along the lower surface of the printed circuit board; and the lower end portions of the first, second, and third antennas electrically contact the respective first, second, and third contact clips to thereby provide a sufficient electrical connection such that the first, second, and third antennas are electrically connected to the printed circuit board without soldering.

14. The vehicular antenna assembly of claim 1, further comprising:

a chassis;

a radome coupled to the chassis such that an interior enclosure is defined by the radome and the chassis; and the at least one antenna, the dielectric antenna carrier, and the printed circuit board are within the interior enclosure.

15. The vehicular antenna assembly of claim 1, wherein the vehicular antenna assembly comprises a shark fin antenna assembly configured for installation to a body wall of a vehicle.

* * * * *